US011156023B2

(12) United States Patent
Iwata et al.

(10) Patent No.: US 11,156,023 B2
(45) Date of Patent: Oct. 26, 2021

(54) VEHICLE DOOR LOCK DEVICE AND METHOD FOR ATTACHING THE SAME

(71) Applicants: MAZDA MOTOR CORPORATION, Hiroshima (JP); U-Shin Ltd., Tokyo (JP)

(72) Inventors: Shinsuke Iwata, Hiroshima (JP); Yusuke Moriwaki, Hiroshima (JP); Koji Yoshioka, Kure (JP); Isao Ochi, Kure (JP); Nobuya Akagi, Kure (JP)

(73) Assignees: MAZDA MOTOR CORPORATION, Hiroshima (JP); U-Shin Ltd., Tokyo (JP)

( * ) Notice: Subject to any disclaimer, the term of this patent is extended or adjusted under 35 U.S.C. 154(b) by 416 days.

(21) Appl. No.: 16/198,948

(22) Filed: Nov. 23, 2018

(65) Prior Publication Data

US 2019/0186180 A1 Jun. 20, 2019

(30) Foreign Application Priority Data

Dec. 19, 2017 (JP) ..... JP2017-242403

(51) Int. Cl.
*E05B 85/06* (2014.01)
*E05B 79/18* (2014.01)
(Continued)

(52) U.S. Cl.
CPC ..... *E05B 85/06* (2013.01); *E05B 17/041* (2013.01); *E05B 79/02* (2013.01); *E05B 79/12* (2013.01);
(Continued)

(58) Field of Classification Search
CPC ..... E05B 17/041; E05B 85/06; E05B 85/14; E05B 79/02; E05B 79/12; E05B 79/18;
(Continued)

(56) References Cited

U.S. PATENT DOCUMENTS 2,427,436 A * 9/1947 Beems ..... E05B 85/10 292/164
2,530,469 A * 11/1950 Jacobi ..... F16D 3/265 70/379 R
(Continued)

FOREIGN PATENT DOCUMENTS

DE 20109250 U1 11/2001
DE 69920789 T2 7/2005
(Continued)

*Primary Examiner* — Suzanne L Barrett
(74) *Attorney, Agent, or Firm* — Studebaker & Brackett PC

(57) ABSTRACT

A vehicle door lock device includes a door handle base provided at a vehicle door and provided with a cylinder lock, and a door latch mechanism provided at the vehicle door. The cylinder lock includes a key cylinder, a paddle portion operably and detachably coupled to the door latch mechanism and configured to transmit rotation of the key cylinder to the door latch mechanism, and a support portion configured to rotatably support the paddle portion. The door latch mechanism includes a key rotor into which the paddle portion is detachably inserted. The paddle portion is supported on the support portion to rotate between a direction of a center axis of the support portion and a direction inclined with respect to the center axis.

8 Claims, 11 Drawing Sheets

(51) Int. Cl.
*E05B 85/16* (2014.01)
*E05B 79/12* (2014.01)
*E05B 17/04* (2006.01)
*E05B 79/02* (2014.01)
*E05B 77/36* (2014.01)

(52) U.S. Cl.
CPC ..... *E05B 79/18* (2013.01); *E05B 85/16* (2013.01); *E05B 77/36* (2013.01); *E05Y 2900/531* (2013.01)

(58) Field of Classification Search
CPC ..... E05B 85/16; E05B 77/36; E05B 27/0007; E05B 27/00; E05Y 2900/531
USPC ..... 70/91, 237, 238
See application file for complete search history.

(56) References Cited

U.S. PATENT DOCUMENTS 2,650,492 A * 9/1953 Jacobi ..... E05B 13/108 70/490
2,750,788 A * 6/1956 Jacobi ..... F16D 3/20 70/379 R
5,224,364 A * 7/1993 Claar ..... E05B 85/06 200/574
6,240,755 B1 * 6/2001 Da Silva ..... E05B 17/186 292/336.3
6,698,262 B2 * 3/2004 Wittwer ..... E05B 85/107 292/336.3
7,171,832 B2 * 2/2007 Umino ..... E05B 17/041 292/216
8,146,393 B2 * 4/2012 Katagiri ..... E05B 85/18 70/208
8,720,240 B2 * 5/2014 Flandrinck ..... F16D 3/20 70/379 R
8,726,705 B2 * 5/2014 Tabe ..... E05B 81/16 70/237
8,997,537 B2 * 4/2015 Zimmer ..... E05B 83/36 70/208
10,006,229 B2 * 6/2018 Beck ..... E05B 81/78
10,533,353 B2 * 1/2020 Smart ..... E05B 81/28
10,774,568 B2 * 9/2020 Saitou ..... E05B 85/06
2002/0056298 A1 * 5/2002 Fukunaga ..... E05B 17/041 70/237
2009/0031771 A1 * 2/2009 Yamaguchi ..... E05B 85/16 70/369
2012/0118029 A1 * 5/2012 Akizuki ..... E05B 81/36 70/91
2014/0123716 A1 * 5/2014 Hidaka ..... E05B 79/06 70/91
2014/0167433 A1 * 6/2014 Gerber ..... E05B 77/44 296/1.02
2015/0233154 A1 8/2015 Smart et al.
2015/0345179 A1 * 12/2015 Kushida ..... E05B 79/22 70/344
2017/0362855 A1 * 12/2017 Kamimura ..... E05B 77/34

FOREIGN PATENT DOCUMENTS

DE 102014102300 A1 8/2014
DE 102015108680 A1 12/2015
EP 2960410 A1 12/2015
JP 2011-026826 A 2/2011
JP 2014-136945 A 7/2014
JP WO2014/196271 A1 12/2014
JP 2016-160722 A 9/2016

* cited by examiner

VEHICLE DOOR LOCK DEVICE AND METHOD FOR ATTACHING THE SAME

CROSS-REFERENCE TO RELATED APPLICATIONS

This application claims priority to Japanese Patent Application No. 2017-242403 filed on Dec. 19, 2017, the entire disclosure of which is incorporated by reference herein.

BACKGROUND

The technique disclosed herein relates to a vehicle door lock device and the method for attaching the vehicle door lock device.

In a typical vehicle door lock device, a key insertion portion of a door cylinder lock is arranged at the periphery of a door handle on a vehicle-outer-side main surface of a vehicle door. Thus, after a door latch mechanism has been attached to the vehicle door, the door cylinder lock can be attached to the vehicle door from a vehicle outer side. As a result, a paddle portion of the door cylinder lock can be easily inserted (i.e., operably coupled) into a key rotor of the door latch mechanism (see Japanese Unexamined Patent Application Publication No. 2011-026826).

SUMMARY

However, in the above-described structure in which the key insertion portion of the door cylinder lock is arranged at the periphery of the door handle on the vehicle-outer-side main surface of the vehicle door (i.e., the structure in which the key insertion portion of the door cylinder lock is exposed at the vehicle-outer-side main surface of the vehicle door), quietness of a vehicle in response to travelling wind might be lowered due to exposure of the key insertion hole.

An idea that the key insertion portion of the door cylinder lock is arranged on a back side of the door handle on the vehicle-outer-side main surface of the vehicle door is conceivable as an idea for solving the above-described disadvantage. In this idea, due to the structure of the vehicle door, the door latch mechanism needs to be attached to the vehicle door after the door cylinder lock has been attached to the vehicle door from the inside of the vehicle door. More specifically, in a state in which the paddle portion of the door cylinder lock is arranged in advance at a position operably coupled to the door latch mechanism, the paddle portion of the door cylinder lock needs to be inserted into the key rotor of the door latch mechanism while the door latch mechanism is moving.

However, due to limitations on an internal space of the vehicle door, it is extremely difficult to insert (i.e., operably couple) the paddle portion of the door cylinder lock into the key rotor of the door latch mechanism while the door latch mechanism is moving as described above.

The technique disclosed herein provides a vehicle door lock device configured such that it is easy to operably couple a paddle portion of a door cylinder lock and a key rotor of a door latch portion to each other in a case where a door latch mechanism is attached to a vehicle door after attachment of the door cylinder lock to the vehicle door, and provides the method for attaching the vehicle door lock device.

The technique disclosed herein relates to a vehicle door lock device. The vehicle door lock device includes a door handle provided at a vehicle door, a door handle base provided at the vehicle door and provided with a cylinder lock, and a door latch mechanism provided at the vehicle door and configured to switch to a lock state or an unlock state according to door key operation for the cylinder lock. The cylinder lock includes a key cylinder to be rotated by a door key, a paddle portion operably and detachably coupled to the door latch mechanism and configured to transmit rotation of the key cylinder to the door latch mechanism, and a support portion configured to rotatably support the paddle portion. The door latch mechanism includes a key rotor into which the paddle portion is detachably inserted and which is configured to rotate in association with rotation of the paddle portion to switch the door latch mechanism to the lock state or the unlocking state. The paddle portion is supported on the support portion to rotate between a direction of a center axis of the support portion and a direction inclined with respect to the center axis.

According to this configuration, the paddle portion of the cylinder lock is supported on the support portion to rotate between a direction of a center axis of the support portion and a direction inclined with respect to the center axis. Thus, in a case where the door latch mechanism is attached to the vehicle door after the cylinder lock has been attached to the vehicle door via the door handle base, it is easy to operably couple the paddle portion and the key rotor to each other.

A key insertion portion of the key cylinder may be arranged on a back side of the door handle at a vehicle-outer-side main surface of the vehicle door. The door handle may be arranged to displace relative to the vehicle door, and may expose or cover the key insertion portion of the key cylinder by displacement.

According to this configuration, when the door key is not inserted into the key insertion portion of the key cylinder (e.g., during vehicle travelling), the key insertion portion is covered with the door handle. Only when the door key is inserted into the key insertion portion, the door handle is displaced so that the key insertion portion can be exposed. With this configuration, the key insertion portion is exposed so that lowering of quietness of a vehicle in response to travelling wind can be prevented.

The key cylinder may be inclined diagonally upward of a vehicle outer side of the vehicle door.

According to this configuration, the door key can be inserted into the key cylinder diagonally from the vehicle upper outer side. Thus, even in a case where the door handle is displaced substantially horizontally to the vehicle outer side of the vehicle door to expose the key insertion portion of the key cylinder, the door key can be inserted into the key cylinder without contacting the door handle.

The paddle portion may be supported to rotate between the direction of the center axis of the support portion and a direction inclined with respect to the center axis.

According to this configuration, in a case where the door latch mechanism is attached to the vehicle door after attachment of the cylinder lock to the vehicle door, the paddle portion is rotated in the direction inclined with respect to the center axis of the support portion upon attachment of the door latch mechanism to the vehicle door, and the door latch mechanism is moved to the attachment portion inside the vehicle door from the side to which the paddle portion is inclined. Thus, the paddle portion can be easily inserted into the key rotor.

The door latch mechanism may include a guide portion configured to guide the paddle portion to a tip end insertion port of the key rotor upon insertion of the paddle portion into the key rotor. The paddle portion may be rotated in the direction inclined with respect to the center axis of the support portion upon attachment of the door latch mechanism to the vehicle door. The guide portion may have a portion protruding to the vehicle outer side of the vehicle door from the side of the periphery of the tip end insertion port of the key rotor to which the paddle portion is inclined with respect to the center axis of the support portion upon attachment of the door latch mechanism to the vehicle door.

According to this configuration, in a case where the door latch mechanism is, after attachment of the cylinder lock to the vehicle door, moved from the side to which the paddle portion is inclined to the attachment portion inside the vehicle door and is attached to the attachment portion, the paddle portion can be easily guided and inserted into the tip end insertion port of the key rotor by the guide portion.

The paddle portion may be supported on the support portion to slide in the direction of insertion/detachment for the key rotor.

According to this configuration, in a case where the door latch mechanism is attached to the vehicle door after attachment of the cylinder lock to the vehicle door, the paddle portion is slid in the direction of detachment from the key rotor upon attachment of the door latch mechanism to the vehicle door. After the door latch mechanism has been attached to the vehicle door, the paddle portion is slid in the direction of insertion into the key rotor. Thus, the paddle portion can be easily inserted into the key rotor.

The door handle base may include a rod operated in association with handle operation for the door handle and operably coupled to the door latch mechanism. The door latch mechanism may include a door latch disengagement lever operably coupled to the rod and configured to disengage a door latch of the vehicle door according to operation of the rod. The door latch disengagement lever may include a rod insertion hole into which the rod is to be inserted, and a rod guide portion provided at a peripheral edge portion of the rod insertion hole and configured to guide an end portion of the rod to the rod insertion hole upon insertion of the rod into the rod insertion hole.

According to this configuration, the rod guide portion is provided at the peripheral edge portion of the rod insertion hole of the door latch disengagement lever. Thus, in a case where the door latch mechanism is attached to the vehicle door after attachment of the cylinder lock to the vehicle door, it is easy to operably couple the end portion of the rod and the door latch disengagement lever to each other.

The technique disclosed herein relates to the method for attaching the above-described vehicle door lock device to a vehicle door. The attachment method includes the first step of attaching the door handle base to the vehicle door and attaching the cylinder lock to the door handle base, the second step of attaching the door latch mechanism to the vehicle door after the first step, and the third step of rotating the paddle portion of the cylinder lock between a direction of a center axis of the support portion and a direction inclined with respect to the center axis at the first step or after the second step.

According to this configuration, the paddle portion of the cylinder lock is rotated between a direction of a center axis of the support portion and a direction inclined with respect to the center axis during the first step or after the second step. Thus, in a case where the door latch mechanism is attached to the vehicle door after attachment of the cylinder lock to the vehicle door, it is easy to operably couple the paddle portion and the key rotor to each other.

The third step may be performed at the first step. At the third step, the paddle portion may be rotated in the direction inclined with respect to the center axis of the support portion. The second step may be performed after the first step and the third step. At the second step, the paddle portion may be inserted into the key rotor while the door latch mechanism is moving to an attachment portion inside the vehicle door from the side to which the paddle portion is rotated.

According to this configuration, in a case where the door latch mechanism is attached to the vehicle door after attachment of the cylinder lock to the vehicle door, the paddle portion can be easily inserted into the key rotor.

The third step may be performed after the second step. At the third step, the paddle portion may be slid in the direction of insertion into the key rotor relative to the support portion, and may be inserted into the key rotor.

According to this configuration, in a case where the door latch mechanism is attached to the vehicle door after attachment of the cylinder lock to the vehicle door, the paddle portion can be easily inserted into the key rotor.

DETAILED DESCRIPTION

A vehicle door lock device 1 will be described with reference to FIGS. 1 to 8. The vehicle door lock device 1 is provided inside a vehicle door of a vehicle such as an automobile to disengage a vehicle-side striker from a vehicle-door-side door latch according to door handle operation for the vehicle door and to switch the vehicle-door-side door latch to a lock state for inhibiting disengagement or an unlock state for allowing disengagement according to door key operation for the vehicle door.

Figure 1:
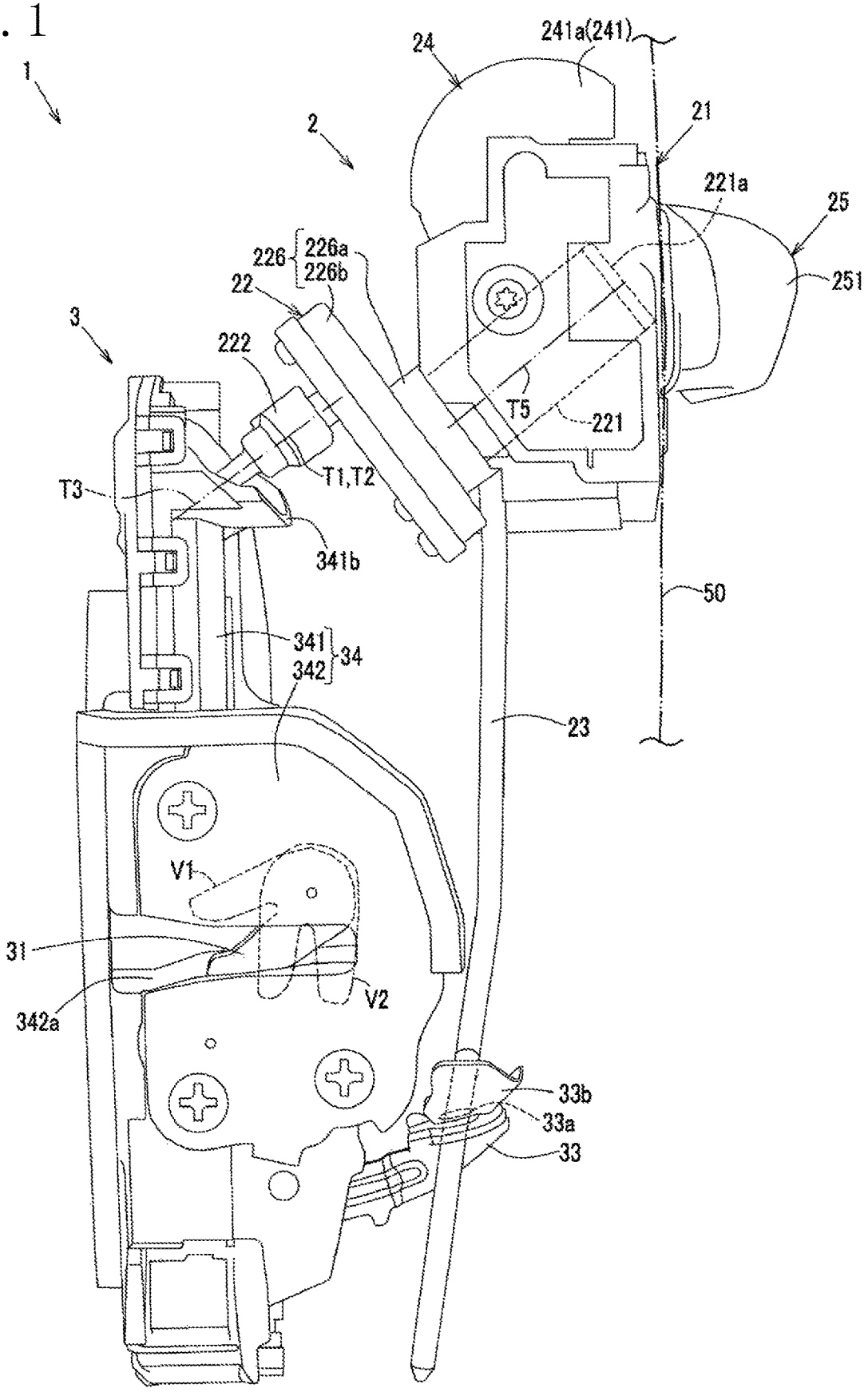
FIG. 1 is a side view of a vehicle door lock device.
Figure 2:
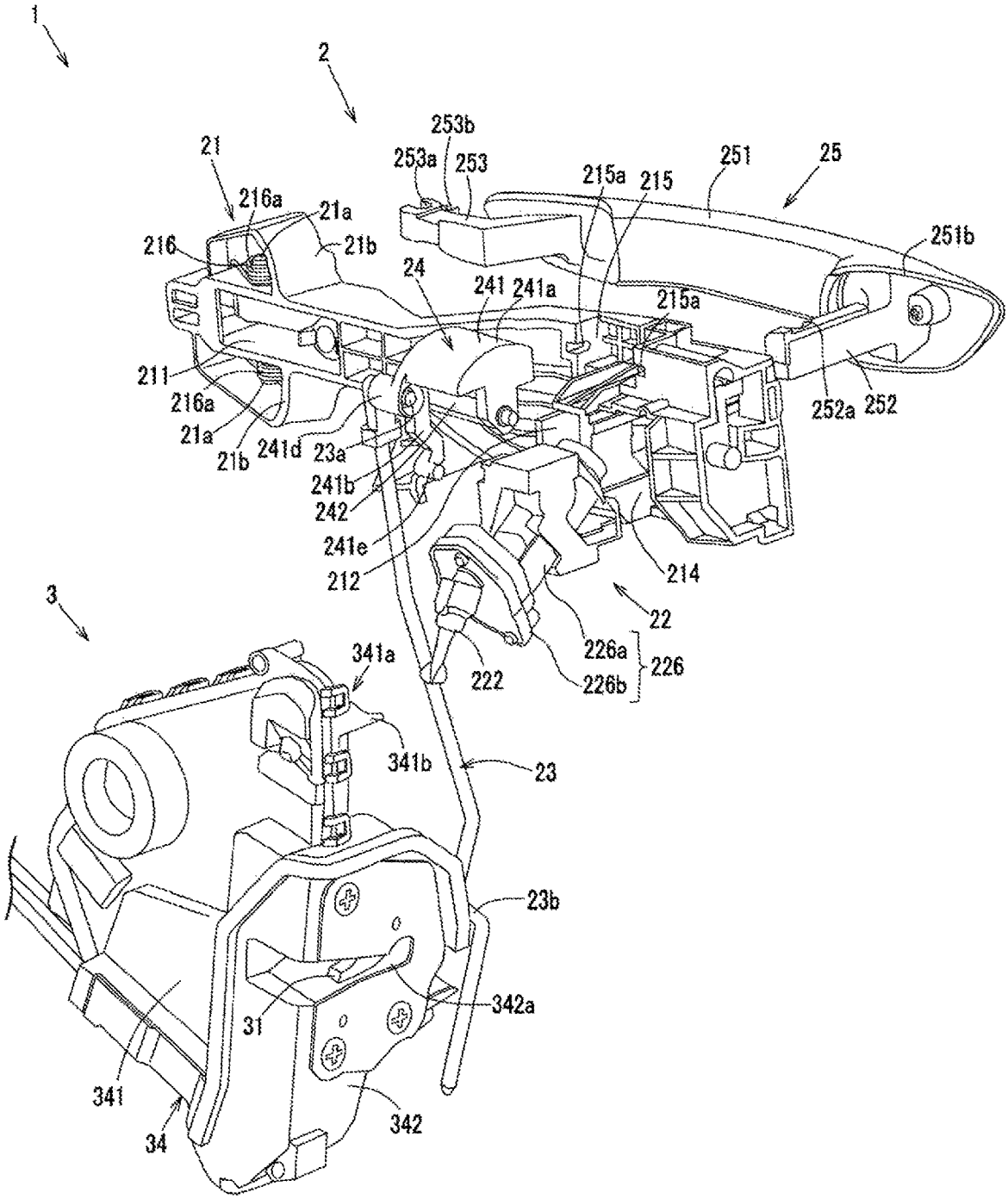
FIG. 2 is an exploded perspective view of the vehicle door lock device from a back side (a vehicle inner side).
Figure 3:
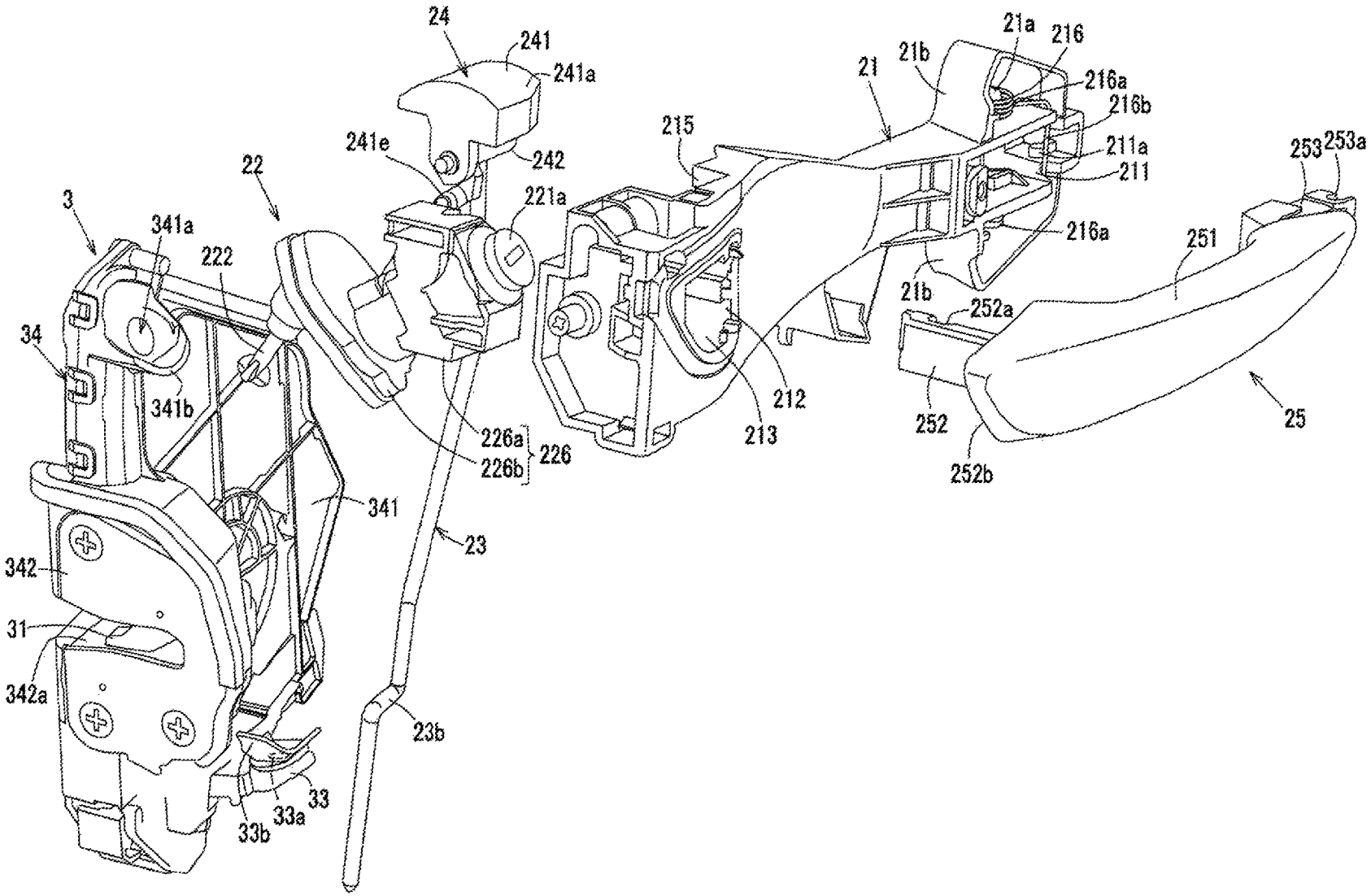
FIG. 3 is an exploded perspective view of the vehicle door lock device from a front side (a vehicle outer side).
Figure 4:
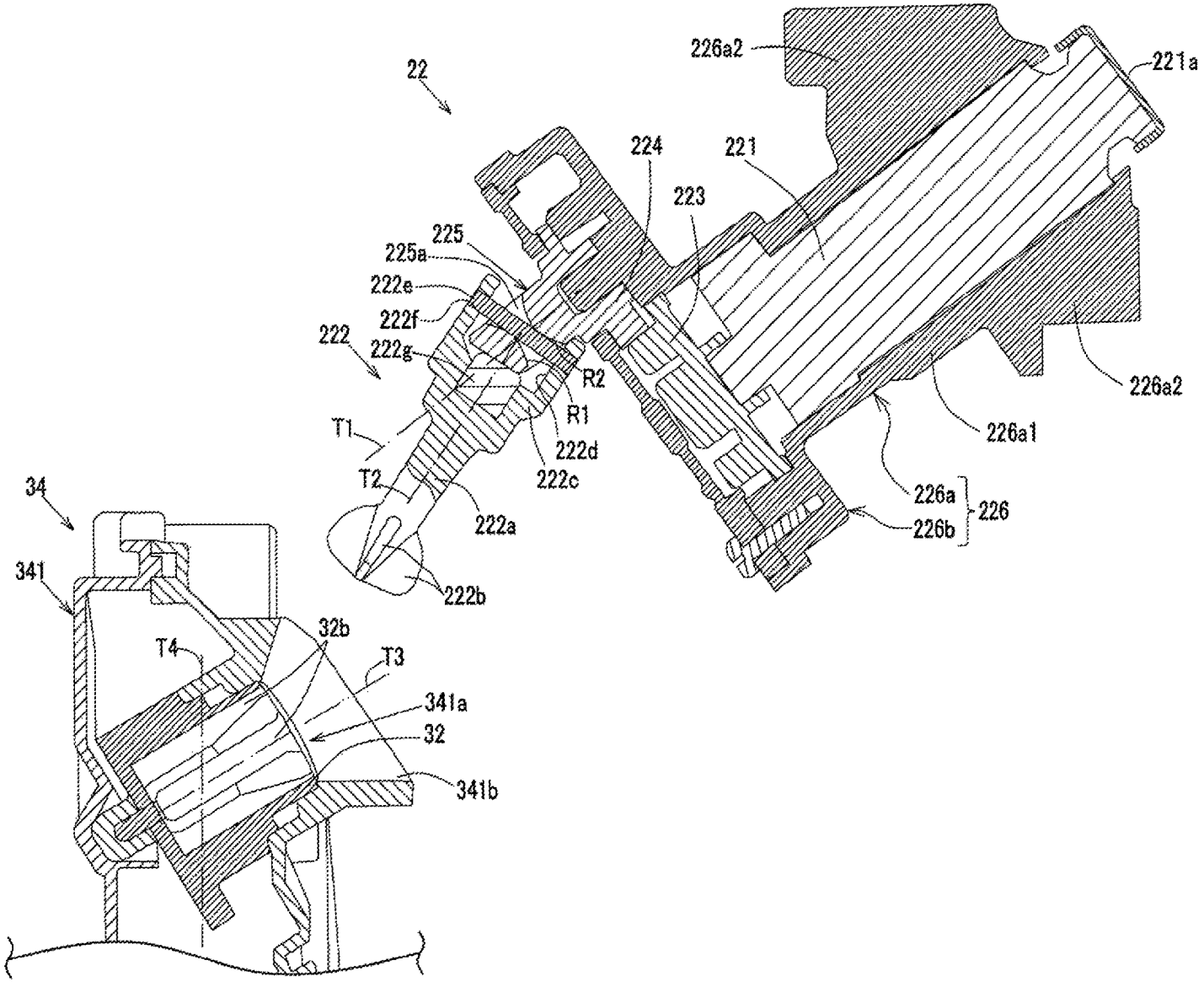
FIG. 4 is a side sectional view in a separation state of a paddle portion of a cylinder lock and a key rotor of a door latch mechanism.

FIG. 1 is a side view of the vehicle door lock device 1, FIG. 2 is an exploded perspective view of the vehicle door lock device 1 from a back side (a vehicle inner side), FIG. 3 is an exploded perspective view of the vehicle door lock device 1 from a front side (a vehicle outer side), and FIG. 4 is a side sectional view of a separation state of a paddle portion 222 of a cylinder lock 22 and a key rotor 32 of a door latch mechanism 3.

As illustrated in FIG. 1, the vehicle door lock device 1 includes a door handle base unit 2 configured to receive the door handle operation and the door key operation, and the door latch mechanism 3 configured to drive a vehicle-door-side door latch 31 according to the door handle operation and the door key operation for the door handle base unit 2.

The door handle base unit 2 is attached to the back side of a door outer panel 50 in a state in which a door handle 25 is arranged on the front side of the door outer panel 50 of the vehicle door. As illustrated in FIGS. 2 and 3, the door handle base unit 2 includes a door handle base 21, the cylinder lock 22, a rod 23, a bell crank 24, and the door handle 25.

The cylinder lock 22 is configured to receive the door key operation by a door key matching the cylinder lock 22, thereby transmitting door key rotation as the door key operation to the door latch mechanism 3. As illustrated in FIG. 4, the cylinder lock 22 includes a key cylinder 221 into which the door key can be inserted and which is rotatable in association with rotation of the inserted door key, the paddle portion 222 operably and disengageably coupled to the door latch mechanism 3 to transmit rotation of the key cylinder 221 to the door latch mechanism 3, multiple (e.g., two) gears 223, 224 configured to transmit rotation of the key cylinder 221 to the paddle portion 222, a support portion 225 configured to rotatably and swingably support the paddle portion 222, and a cylinder lock housing 226 assembled with each of these components 221, 222, 223, 224, 225.

The cylinder lock housing 226 includes a key cylinder housing portion 226*a* configured to house the key cylinder 221, and a gear housing portion 226*b* configured to house the gears 223, 224.

The key cylinder housing portion 226*a* includes a key cylinder housing body 226*a*1 formed in a shape (e.g., a substantially cylindrical shape) in accordance with the outer shape of the key cylinder 221, and fitting portions 226*a*2 provided on an outer peripheral surface of the key cylinder housing body 226*a*1.

The fitting portion 226*a*2 is a portion fitted and attached to the door handle base 21. The fitting portions 226*a*2 are formed to project in a substantially triangular shape on both of upper and lower sides of an upper half portion of the key cylinder housing body 226*a*1, and the upper half portion of the key cylinder housing body 226*a*1 is formed in a substantially rectangular parallelepiped shape (i.e., a substantially rectangular shape as viewed from the side). The key cylinder housing body 226*a*1 is arranged along a diagonal line of the rectangular shape as viewed from the side. Thus, the key cylinder housing body 226*a*1 is fitted and attached to the door handle base 21 in an inclined state with respect to an upper-to-lower direction. That is, the key cylinder 221 is, at the door handle base 21, arranged inclined with respect to the upper-to-lower direction.

The gear housing portion 226*b* is, for example, formed in a flat-plate box shape. One (e.g., an upper main surface) of two main surfaces of the gear housing portion 226*b* is coupled to a lower end portion of the key cylinder housing body 226*a*1 such that internal spaces thereof communicate with each other.

As described below, the key cylinder 221, each gear 223, 224, and the support portion 225 are attached to the cylinder lock housing 226 configured as described above. That is, the key cylinder 221 is housed in the key cylinder housing body 226*a*1 along a longitudinal direction of the key cylinder housing body 226*a*1. A tip end portion of the key cylinder 221 is exposed through a tip end portion of the key cylinder housing body 226*a*1, and forms a key insertion portion 221*a* into which the door key is inserted.

The support portion 225 is, for example, formed in a quadrangular prism shape, and stands in a protruding state on the other one (i.e., a main surface opposite to the key cylinder housing portion 226*a*) of two main surfaces of the gear housing portion 226*b* to rotate about the center axis T1 of the support portion 225. The paddle portion 222 is coupled to a tip end portion of the support portion 225 to swing to both sides of the center axis T1 of the support portion 225. That is, the paddle portion 222 is rotatable between the direction of the center axis T1 of the support portion 225 and a direction inclined with respect to the center axis T1.

The gears 223, 224 are, for example, spur gears, are arranged in the plane of the gear housing portion 226*b*, and are rotatably housed in an engagement state. A rotary shaft portion of one gear 223 is integrally rotatably and concentrically coupled to the key cylinder 221, and a rotary shaft portion of the other gear 224 is integrally rotatably and concentrically coupled to the support portion 225.

The paddle portion 222 includes, for example, a rod-shaped paddle body 222*a*, engagement portions 222*b* provided at a tip end portion of the paddle body 222*a*, and a coupling portion 222*c* provided at a base end portion of the paddle body 222*a*. The paddle portion 222 is, at a tip end portion thereof, inserted into the later-described key rotor 32 of the door latch mechanism 3, and accordingly, is operably coupled to the key rotor 32.

The engagement portions 222*b* are portions for integrally rotatably and disengageably engaging the tip end portion of the paddle portion 222 with the later-described key rotor 32 of the door latch mechanism 3. The engagement portions 222*b* include, for example, multiple engagement pieces. At the outer periphery of the tip end portion of the paddle body 222*a*, the engagement portions 222*b* are provided at intervals in a circumferential direction, and stand along the direction of the center axis T2 of the paddle body 222*a*. The coupling portion 222*c* is coupled to rotate integrally with the support portion 225 and to swing up and down about the center axis T1 of the support portion 225. That is, the coupling portion 222*c* (and therefore, the paddle portion 222) is rotatable between the center axis T1 of the support portion 225 and the direction inclined with respect to the center axis T1.

When the key cylinder 221 is rotated by the door key, such rotation is, in the cylinder lock 22 configured as described above, sequentially transmitted to each gear 223, 224 and the support portion 225 to rotate the paddle portion 222.

The paddle portion 222 will be further described. As illustrated in FIG. 4, the coupling portion 222*c* of the paddle portion 222 is formed in a circular columnar shape with a greater diameter than that of the paddle body 222*a*, and is provided concentrically with the base end portion of the paddle body 222*a*. An insertion recessed portion 222*d* into which the tip end portion of the support portion 225 can be inserted is provided at a base end surface of the coupling portion 222*c*. Through-holes 222*f* into which a retaining pin 222*e* for coupling the coupling portion 222*c* and the tip end portion of the support portion 225 to each other is inserted are provided at a peripheral wall portion of the insertion recessed portion 222*d*. Two through-holes 222*f* are provided on both sides of the coupling portion 222*c* along the diameter of the coupling portion 222*c*. The retaining pin 222*e* is formed in a circular columnar rod shape.

An elastic member (e.g., a rubber member) 222*g* is arranged in the back of the insertion recessed portion 222*d*. The elastic member 222*g* is configured to contact a tip end surface of the support portion 225 in a coupling state of the coupling portion 222*c* and the support portion 225 to determine the position of the paddle portion 222 at a position inclined at a predetermined angle with respect to the center axis T1 of the support portion 225.

The tip end portion of the support portion 225 is formed in a circular columnar shape so that the tip end portion can be inserted into the insertion recessed portion 222*d* of the coupling portion 222*c*. A through-hole 225*a* into which the retaining pin 222*e* is inserted is provided at an outer peripheral surface of the support portion 225. The through-hole 225*a* is provided to penetrate the support portion 225 along the diameter thereof. That is, in a state in which the tip end portion of the support portion 225 is inserted into the insertion recessed portion 222*d* of the coupling portion 222*c*, the retaining pin 222*e* is arranged through both through-holes 222*f* of the coupling portion 222*c* and the through-hole 225*a* of the support portion 225, and accordingly, the coupling portion 222*c* (and therefore, the paddle portion 222) is coupled to the support portion 225.

The diameter of the through-hole 225*a* in the direction of the center axis T1 of the support portion 225 (i.e., a tip-to-base direction of the support portion 225) increases in the direction of the center axis T1 from the center of the through-hole 225*a* in a hole axis direction thereof toward both ends of the through-hole 225*a* in the hole axis direction thereof. More specifically, when the section of the through-hole 225*a* is viewed from the side as illustrated in FIG. 4, a tip-end-side hole outline R1 of the support portion 225 curves in a shape (e.g., an arc shape) curved toward the tip end portion of the support portion 225 from the center to both ends in the hole axis direction, and a base-end-side hole outline R2 of the support portion 225 curves in a shape (e.g., an arc shape) curved toward a base end portion of the support portion 225 from the center to both ends in the hole axis direction.

As described above, the diameter of the through-hole 225*a* in the direction of the center axis T1 increases in the direction of the center axis T1 from the center of the through-hole 225*a* in the hole axis direction thereof to both ends of the through-hole 225*a* in the hole axis direction thereof, and therefore, the coupling portion 222*c* (and therefore, the paddle portion 222) is rotatable about the retaining pin 222*e* in an axial direction of the retaining pin 222*e* in a state in which the coupling portion 222*c* is coupled to the tip end portion of the support portion 225. That is, the paddle portion 222 is swingable to any side in a circumferential direction of the support portion 225 with respect to the center axis T1 of the support portion 225.

The tip end surface of the support portion 225 is inclined with respect to the center axis T1 of the support portion 225. For example, the tip end surface of the support portion 225 is inclined from a tip end side to a base end side of the support portion 225 as the tip end surface extends from one opening side to the other opening side of the through-hole 225*a* of the support portion 225. In the coupling state of the support portion 225 and the coupling portion 222*c*, the tip end surface of the support portion 225 contacts, e.g., a flat base end surface of the elastic member 222*g* in the back of the insertion recessed portion 222*d* of the coupling portion 222*c*. Since the tip end surface of the support portion 225 is inclined as described above, the position of the coupling portion 222*c* (and therefore, the paddle portion 222) is determined by the elastic member 222*g* such that the coupling portion 222*c* is inclined in an inclination direction of the tip end surface of the support portion 225 with respect to the center axis T1 of the support portion 225.

Referring back to FIGS. 2 and 3, the rod 23 is configured to transmit the door handle operation for the door handle 25 to a later-described door latch disengagement lever of the door latch mechanism 3, and for example, is formed in a vertically-elongated rod shape. A rod coupling portion 23*a* (see FIG. 2) for coupling to the bell crank 24 is provided at an upper end portion of the rod 23, and a rod engagement portion 23*b* (see FIG. 3) for engagement with the door latch disengagement lever 33 is provided at a lower portion of the rod 23. The rod coupling portion 23*a* is, for example, formed as a coupling shaft portion. The rod coupling portion 23*a* is provided to extend perpendicularly from the upper end portion of the rod 23, and protrudes in a lateral width direction of the vehicle door. The rod engagement portion 23*b* is formed such that the rod 23 bends in a crank shape (i.e., a shape bent downward after having bent in a lateral direction and having extended by a certain length) at the lower portion.

The bell crank 24 is configured to convert the handle operation as operation in the horizontal direction into operation in the upper-to-lower direction, and includes a bell crank body 241 coupled to the rod 23 and the door handle 25 and a rotary shaft portion 242 rotatably supported on the door handle base 21.

The rotary shaft portion 242 extends in the lateral width direction of the vehicle door, and for example, both end portions of the rotary shaft portion 242 are rotatably supported on the door handle base 21. The bell crank body 241 is coupled to the rotary shaft portion 242, is formed in a substantially inverted L-shape as viewed the side, i.e., as viewed from an axial direction of the rotary shaft portion 242, and includes a lateral side portion 241*a* and a longitudinal side portion 241*b*.

The lateral side portion 241*a* is formed to extend in a thickness direction of the vehicle door, and the longitudinal side portion 241*b* is provided to extend downward from a base end portion (i.e., a vehicle-inner-side end portion in the thickness direction of the vehicle door) of the lateral side portion 241*a*. The rotary shaft portion 242 is coupled to the lateral side portion 241*a* via a support portion extending downward from the lateral side portion 241*a*. More specifically, the lateral side portion 241*a* is formed in a plate shape (e.g., a substantially arc plate shape as viewed from the side) expanding in the lateral width direction of the vehicle door. The longitudinal side portion 241*b* is, for example, formed in a rod shape, and is provided to extend downward from an end portion of the base end portion of the lateral side portion 241*a* in the lateral width direction to avoid contact of the door handle 25 with a later-described operation arm portion 252.

The longitudinal side portion 241*b* includes a coupling target portion 241*d* to which the rod coupling portion 23*a* of the rod 23 is rotatably coupled, and an engagement target portion 241*e* engaging with the later-described operation arm portion 252 of the door handle 25.

For example, the coupling target portion 241*d* is formed as such a through-hole that the rod coupling portion 23*a* as a rotary shaft portion is insertable and rotatable. The coupling target portion 241*d* is provided at an upper portion of the longitudinal side portion 241*b*, and penetrates the upper portion of the longitudinal side portion 241*b* in the lateral width direction of the vehicle door. For example, the engagement target portion 241*e* is formed as a circular columnar engagement protruding portion engageable with an engagement recessed portion 252*a* of the door handle 25 described later, and protrudes in the lateral width direction of the vehicle door from a lower portion (i.e., a portion lower than the coupling target portion 241*d*) of the longitudinal side portion 241*b*.

The door handle 25 is a portion to be gripped for the door handle operation, and includes a door handle body 251, the operation arm portion 252 engaging with the engagement target portion 241*e* of the bell crank 24, and an engagement arm portion 253 rotatably engaging with the door handle base 21.

The door handle body 251 is formed in a rod shape extending in the lateral width direction of the vehicle door, for example.

The operation arm portion 252 is, for example, formed in a substantially rectangular parallelepiped straight rod shape, and stands toward the vehicle inner side at one end portion of the door handle body 251 in the lateral width direction on a back surface of the door handle body 251. The engagement recessed portion 252*a* rotatably engaging with the engagement target portion 241*e* (i.e., the engagement protruding portion) of the bell crank 24 is provided at a side surface of a tip end portion of the operation arm portion 252.

The engagement arm portion 253 is, for example, formed in a substantially L-rod shape as viewed from the bottom, and stands toward the vehicle inner side at the other end portion (i.e., an end portion opposite to the operation arm portion 252) of the door handle body 251 in the lateral width direction on the back surface of the door handle body 251. A tip end portion of the engagement arm portion 253 bends to a side opposite to the operation arm portion 252.

Engagement recessed groove portions 253*a* formed in a U-shaped as viewed from the bottom and rotatably engaging with a pair of later-described rotary shaft portions 211*a* of the door handle base 21 are provided at both of upper and lower surfaces of the tip end portion of the engagement arm portion 253. End portions of the engagement recessed groove portions 253*a* open at a tip end surface of the engagement arm portion 253, and the later-described rotary shaft portions 211*a* of the door handle base 21 can be inserted through these opening end portions. An engagement recessed portion 253*b* engaging with a restriction portion 216*b* of a later-described spring member 216 is provided at a vehicle-outer-side surface of the tip end portion of the engagement arm portion 253.

The other end portion 251*b* of the door handle body 251 in the lateral width direction at the back surface of the door handle body 251 forms a lid portion configured to openably cover a later-described key insertion opening 213 and a later-described operation arm insertion hole 212 at a front surface of the door handle base 21. Hereinafter, the other end portion 251*b* will be also referred to as a "lid portion 251*b*."

The door handle base 21 is a base member to which the cylinder lock 22, the rod 23, the bell crank 24, and the door handle 25 are attached and which is fixed to the inside of the vehicle door, and is formed in a horizontally-elongated plate shape, for example. The door handle base 21 is attached to a back surface of the door outer panel 50 (see FIG. 1) of the vehicle door such that the front surface (a vehicle-outer-side main surface) of the door handle base 21 overlaps with the back surface of the door outer panel 50.

The door handle base 21 includes an engagement arm housing recessed portion 211 configured to house the engagement arm portion 253 of the door handle 25, the operation arm insertion hole 212 into which the operation arm portion 252 of the door handle 25 can be inserted, the key insertion opening 213 in which the key insertion portion 221*a* of the cylinder lock 22 is arranged, a cylinder lock attachment recessed portion 214 attached to the cylinder lock 22, and a bell crank housing recessed portion 215 configured to house the bell crank 24. Moreover, the door handle base 21 includes the spring member 216 configured to autonomously return the door handle 25 to an original position in response to the handle operation.

The engagement arm housing recessed portion 211 is provided at one end portion of the door handle base 21 in the lateral width direction at the front surface of the door handle base 21, and is formed in a substantially horizontally-elongated rectangular parallelepiped shape in accordance with the shape of the engagement arm portion 253 (see FIG. 3). An upper-to-lower width in the engagement arm housing recessed portion 211 is formed narrower at an outer end portion in the lateral width direction in a step shape, and the tip end portion of the engagement arm portion 253 of the door handle 25 can be fitted in the engagement arm housing recessed portion 211. Moreover, the rotary shaft portions 211*a* rotatably engaging with the engagement recessed groove portions 253*a* of the tip end portion of the engagement arm portion 253 stand on both of upper and lower surfaces of the step-shaped narrowed portion of the engagement arm housing recessed portion 211.

The operation arm insertion hole 212 is provided at the other end portion (i.e., a side opposite to the engagement arm housing recessed portion 211) of the door handle base 21 in the lateral width direction at the front surface of the door handle base 21, and penetrates the door handle base 21 in a thickness direction thereof.

The key insertion opening 213 is provided at the other end portion (e.g., next to the operation arm insertion hole 212) of the door handle base 21 in the lateral width direction at the front surface of the door handle base 21, and is formed as an opening larger than the key insertion portion 221*a* of the cylinder lock 22.

The cylinder lock attachment recessed portion 214 is provided at a portion of a back surface of the door handle base 21 overlapping with the key insertion opening 213, and is formed in such a substantially rectangular parallelepiped shape that a substantially rectangular parallelepiped upper half portion of the key cylinder housing portion 226*a* of the cylinder lock 22 can be fitted. The key insertion opening 213 communicates with the cylinder lock attachment recessed portion 214 at a back surface thereof.

The bell crank housing recessed portion 215 is provided on an upper side of the operation arm insertion hole 212 at the back surface of the door handle base 21. Recessed groove portions 215*a* rotatably engaging with both end portions of the rotary shaft portion 242 of the bell crank 24 are provided at both side surfaces of the bell crank housing recessed portion 215 in the lateral width direction.

The recessed groove portions 215*a* are provided along the thickness direction of the door handle base 21, and end portions of the recessed groove portions 215*a* open at the back surface of the door handle base 21. That is, the end portions of the rotary shaft portion 242 of the bell crank 24 are engaged into the recessed groove portions 215*a* through these opening end portions (hereinafter also referred to as "opening ends"). The bell crank housing recessed portion 215 communicates with the operation arm insertion hole 212 through a communication groove 218 provided at the back surface of the door handle base 21 (see FIG. 5).

The spring member 216 is, for example, a double torsion spring, and includes two coil springs 216*a*, the substantially U-shaped restriction portion 216*b* formed by coupling of end portions of the coil springs 216*a*, and engagement ends (not shown) as free ends of two coil springs 216*a*. Winding shaft portions 21*a* and engagement target portions 21*b* stand on outer surfaces of both of upper and lower surfaces of the end portion (i.e., the end portion closer to the engagement arm housing recessed portion 211) of the door handle base 21 in the lateral width direction. Each coil spring 216*a* is wound around a corresponding one of the winding shaft portions 21*a*, and each engagement end engages with a corresponding one of the engagement target portions 21*b*. The restriction portion 216*b* is arranged over a front opening surface of the engagement arm housing recessed portion 211 of the door handle base 21. The restriction portion 216*b* is, by the coil springs 216*a*, biased in the direction of pressing the restriction portion 216*b* against the front opening surface of the engagement arm housing recessed portion 211.

Figure 5:
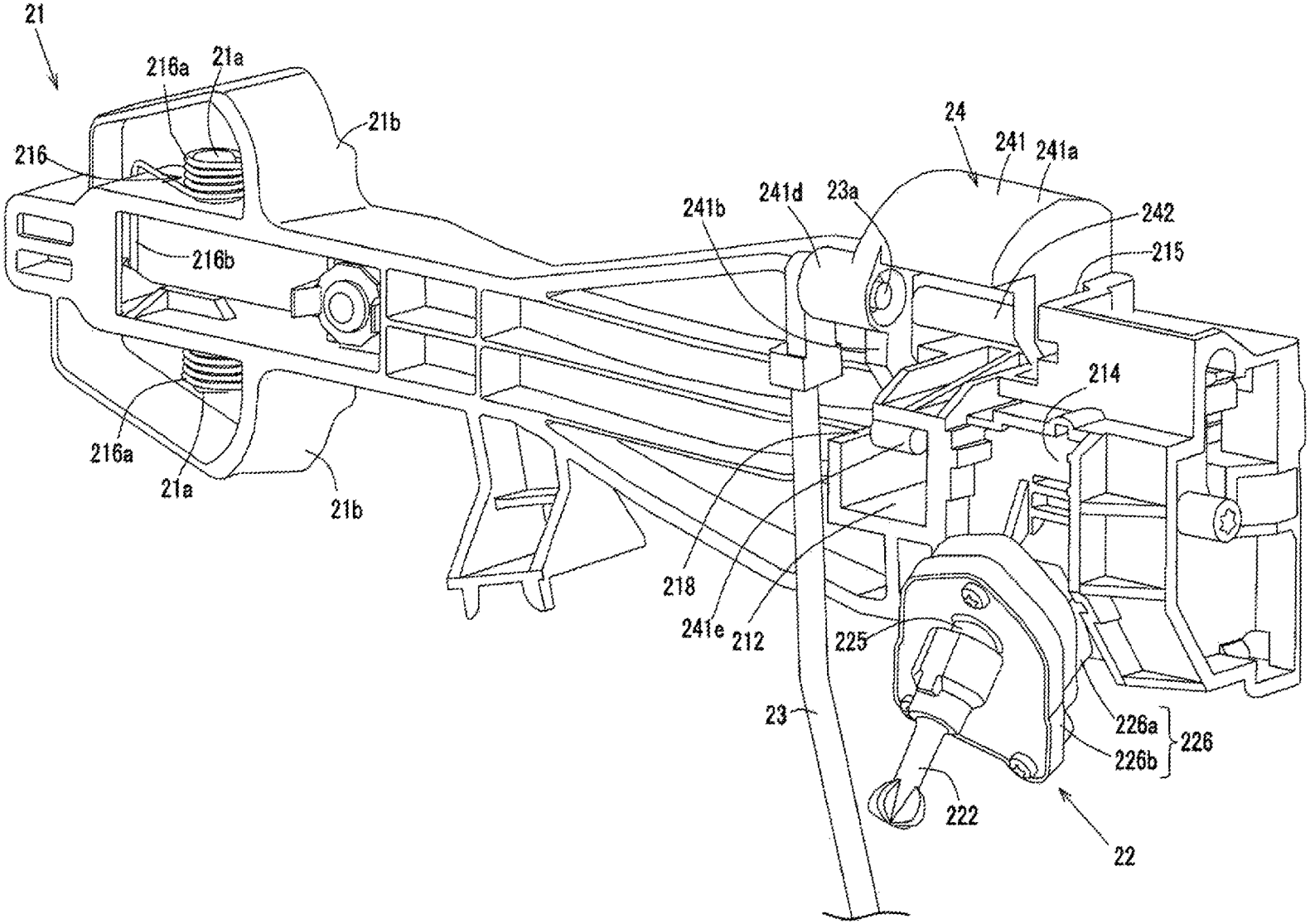
FIG. 5 is a perspective view from a back side of a door handle base in a state in which each component is attached to the door handle base.
Figure 6:
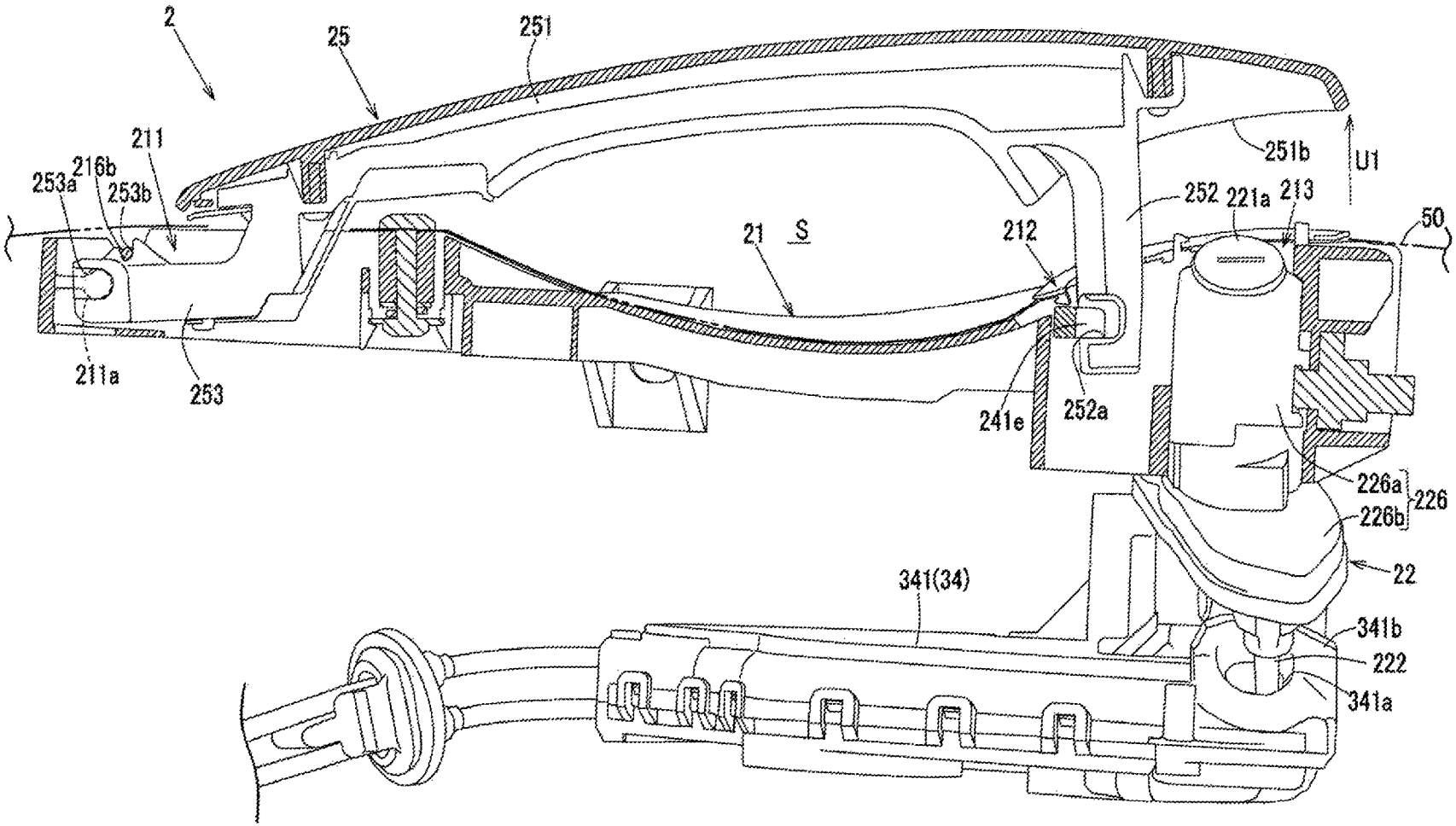
FIG. 6 is a partial sectional view as viewed in plane, i.e., as viewed from above the door handle base, in the state in which each component is attached to the door handle base.

FIGS. 5 and 6 are a perspective view from the back side of the door handle base 21 and a plan view as viewed from above in a state in which each component (the cylinder lock 22, the rod 23, the bell crank 24, and the door handle 25) is attached to the door handle base 21. Note that the door handle 25 is not shown in FIG. 5, and the horizontal sections of the door handle base 21 and the door handle 25 are illustrated in FIG. 6.

As illustrated in FIG. 5, the cylinder lock 22 is attached to the door handle base 21 in a state in which the cylinder lock 22 is housed in the cylinder lock attachment recessed portion 214 of the back surface of the door handle base 21. In this attachment state, the substantially rectangular parallelepiped upper half portion of the key cylinder housing portion 226*a* is fitted and attached to the cylinder lock attachment recessed portion 214.

By such fitting and attachment, the key cylinder housing portion 226*a* is inclined to the vehicle outer side in the thickness direction of the vehicle door with respect to the vertical direction. Thus, the key cylinder 221 in the key cylinder housing portion 226*a* is also inclined to the vehicle outer side in the thickness direction of the vehicle door with respect to the vertical direction (see FIG. 1). Moreover, in the above-described fitting state, the key insertion portion 221*a* as an upper end portion of the key cylinder 221 is arranged in the key insertion opening 213 of the front surface of the door handle base 21, and faces diagonally upward of the vehicle outer side (see FIGS. 1 and 6).

The bell crank 24 is attached to the door handle base 21 in a state in which the bell crank 24 is housed in the bell crank housing recessed portion 215 of the back surface of the door handle base 21. In such an attachment state, the rotary shaft portion 242 of the bell crank 24 is rotatably supported in the back of the recessed groove portions 215*a* of both of the right and left side surfaces of the bell crank housing recessed portion 215. Moreover, in the above-described attachment state, the engagement target portion 241*e* of the longitudinal side portion 241*b* of the bell crank 24 is drawn from the bell crank housing recessed portion 215 to the operation arm insertion hole 212 through the communication groove 218. The rod coupling portion 23*a* of the rod 23 is rotatably coupled to the coupling target portion 241*d* of the bell crank 24, and the rod 23 suspends down on the back side of the door handle base 21.

As illustrated in FIG. 6, the door handle 25 is attached to the front surface of the door handle base 21. In such an attachment state, the engagement arm portion 253 is housed in the engagement arm housing recessed portion 211 of the front surface of the door handle base 21, and the rotary shaft portions 211*a* on both of the upper and lower sides of the engagement arm housing recessed portion 211 rotatably engage with the engagement recessed groove portions 253*a* on both of the upper and lower sides of the tip end portion of the engagement arm portion 253. Moreover, the restriction portion 216*b* of the spring member 216 of the door handle base 21 engages with the engagement recessed portion 253*b* of the tip end portion of the engagement arm portion 253, and biases the engagement arm portion 253 in the direction of pushing the engagement arm portion 253 to the back of the engagement arm housing recessed portion 211. Further, the operation arm portion 252 is inserted into the operation arm insertion hole 212 from the front side of the door handle base 21, and the engagement recessed portion 252*a* of the tip end portion of the operation arm portion 252 engages with the engagement target portion 241*e* of the longitudinal side portion 241*b* of the bell crank 24.

In such an attachment state, the door handle 25 is rotatable about the rotary shaft portions 211*a* of the door handle base 21. When the door handle operation is performed, a user pulls the door handle body 251 in a direction (i.e., the vehicle outer side, a direction indicated by an arrow U1 of FIG. 6) away from the door handle base 21, and accordingly, the door handle 25 is rotated to the vehicle outer side about the rotary shaft portions 211*a*. By such rotation, the longitudinal side portion 241*b* of the bell crank 24 is pulled to the vehicle outer side by the operation arm portion 252 of the door handle 25. By such pulling, the bell crank 24 rotates about the rotary shaft portion 242, and the rod 23 coupled to the longitudinal side portion 241*b* of the bell crank 24 moves downward (see FIG. 5). By such movement, the door latch disengagement lever 33 of the door latch mechanism 3 is operated as described later, and the door latch mechanism 3 is switched to the state for disengaging the latch from the striker.

In a state in which the door handle state has been performed, the key insertion opening 213 of the front surface of the door handle base 21 opens. As a result, the key insertion portion 221*a* in the key insertion opening 213 is exposed to the outside, and the door key can be inserted into the key insertion portion 221*a* diagonally from a vehicle upper outer side.

On the other hand, the door handle body 251 is released to cancel the door handle operation. In such a cancellation state, the engagement arm portion 253 of the door handle 25 is biased to the back of the engagement arm housing recessed portion 211 by biasing force of the spring member 216 of the door handle base 21. By such biasing, the door handle 25 returns to the original position (i.e., a state in which both end portions of the back surface of the door handle body 251 in the lateral width direction contact the front surface of the door handle base 21) before the handle operation. Accordingly, the operation arm portion 252 of the door handle 25 is inserted to the back of the operation arm insertion hole 212. By such insertion, the bell crank 24 rotates in a reverse direction about the rotary shaft portion 242, and the rod 23 coupled to the longitudinal side portion 241*b* of the bell crank 24 is moved to an original position on the upper side.

Moreover, in a state in which the door handle 25 returns to the original position before the handle operation, the other end portion (i.e., the lid portion) 251*b* of the back surface of the door handle body 251 in the lateral width direction covers and closes the key insertion opening 213 and the operation arm insertion hole 212 of the door handle base 21. That is, the key insertion portion 221*a* cannot be visually checked from the outside. A space S for gripping the door handle body 251 is ensured between a center portion of the door handle body 251 in the lateral width direction and the door handle base 21.

As illustrated in FIG. 1, the door latch mechanism 3 is arranged diagonally on a vehicle lower inner side of the door handle base unit 2 in the vehicle door. More specifically, the door latch mechanism 3 is, on the back side of the door handle base unit 2, arranged such that the center axis T3 of the key rotor 32 as described later is substantially coincident with the center axis T1 of the support portion 225 of the cylinder lock 22.

As illustrated in FIGS. 1 to 4, the door latch mechanism 3 includes the door latch 31 to be engaged with the vehicle-body-side striker, the key rotor 32 (see FIG. 4) configured to rotate in association with rotation of the paddle portion 222 of the door handle base unit 2, the door latch disengagement lever 33 operated by the rod 23 of the door handle base unit 2, a lock/unlock switching portion (not shown) configured to allow (i.e., unlock) or inhibit (i.e., lock) driving of the door latch 31 according to rotation of the key rotor 32, a door latch drive portion (not shown) configured to drive the door latch 31 according to operation of the door latch disengagement lever 33, and a case 34 configured to house these components.

The case 34 includes a substantially flat plate box-shaped case body 341 and a box-shaped door latch attachment portion 342. The door latch attachment portion 342 projects to the vehicle outer side from an end portion of the case body 341 in the lateral width direction.

Of two main surfaces of the door latch attachment portion 342, the outer main surface is provided with a striker recessed groove portion 342*a* into which the vehicle-body-side striker (not shown) is inserted. The striker recessed groove portion 342*a* is provided to extend in a lateral width direction of the door latch attachment portion 342 (i.e., a thickness direction of the case body 341), and opens at a vehicle-inner-side surface of the door latch attachment portion 342 in the lateral width direction. Both of upper and lower surfaces of the striker recessed groove portion 342*a* are open. The door latch 31 is, at a tip end portion thereof, formed in a fork shape. The door latch 31 is arranged over the striker recessed groove portion 342*a* in the upper-to-lower direction. A base end portion of the door latch 31 is, in the door latch attachment portion 342, fixed to rotate in a longitudinal direction of the striker recessed groove portion 342*a*.

The door latch 31 is rotatable between a disengagement position V1 and an engagement position V2. The disengagement position V1 is a rotation position at which the door latch 31 is inclined to an inlet side of the striker recessed groove portion 342*a* and a fork-shaped opening of a tip end portion of the door latch 31 communicates with the striker recessed groove portion 342*a*. The engagement position V2 is a rotation position at which the door latch 31 is arranged substantially perpendicularly to the longitudinal direction of the striker recessed groove portion 342*a* and the fork-shaped opening of the tip end portion of the door latch 31 is closed by a side surface of the striker recessed groove portion 342*a*.

In the state of disengaging the door latch 31 from the striker, the door latch 31 is rotated to the disengagement position V1 by the above-described door latch drive portion. In this state, the striker enters the fork-shaped portion of the door latch 31 through the striker recessed groove portion 342*a*. When the door latch 31 is rotated to the engagement position V2 with the striker being in the fork-shaped portion of the door latch 31, the rotation position of the door latch 31 is held at the engagement position V2 by the above-described door latch drive portion. This holding state is the state of engaging the door latch 31 with the striker.

As illustrated in FIG. 4, the key rotor 32 is formed in such a tubular shape that the tip end portion of the paddle portion 222 can be inserted into the key rotor 32. Multiple engagement grooves 32*b* engaging the engagement portions 222*b* of the tip end portion of the paddle portion 222 are provided at an inner peripheral surface (i.e., an inner tube portion) of the key rotor 32. The engagement grooves 32*b* are provided to extend from a tip end insertion port side of the key rotor 32 to the back, and are provided at intervals in a circumferential direction of the inner peripheral surface of the key rotor 32.

The key rotor 32 is arranged at an upper portion of the vehicle-outer-side main surface of two main surfaces of the case body 341. More specifically, a key rotor opening 341*a* is provided at the upper portion of the vehicle-outer-side main surface of the case body 341. The key rotor 32 is rotatably housed and arranged in the case body 341 such that a tip end insertion port of the key rotor 32 is arranged in the key rotor opening 341*a* (see FIG. 7) of the case body 341. In such a housing arrangement state, the center axis T3 of the key rotor 32 is inclined to the vehicle outer side with respect to the upper-to-lower axis T4 of the case body 341, and the tip end insertion hole of the key rotor 32 faces diagonally upward of the vehicle outer side.

The key rotor 32 is rotatable between a lock position and a unlock position (an unlocking position). The lock position is a rotation position at which rotation of the door latch 31 is inhibited (locked), and the unlock position is a rotation position at which rotation of the door latch 31 is allowed (unlocked).

A guide portion 341*b* configured to guide the paddle portion 222 to the tip end insertion port of the key rotor 32 is provided at a peripheral edge portion (i.e., the periphery of the tip end insertion port of the key rotor 32) of the key rotor opening 341*a* of the case body 341. The guide portion 341*b* is formed in the form of a peripheral wall expanding to an outer peripheral side as extending toward a tip end side.

More specifically, an edge portion of the guide portion 341*b* on a lower side (i.e., a side of the periphery of the tip end insertion port of the key rotor 32 to which the paddle portion 222 is inclined with respect to the center axis T1 of the support portion 225 upon attachment of the door latch mechanism 3 to the vehicle door) of the key rotor opening 341*a* protrudes substantially horizontally toward the vehicle outer side or slightly inclined upward toward the vehicle outer side. Moreover, an edge portion of the guide portion 341*b* on an upper side (i.e., a side of the periphery of the tip end insertion port of the key rotor 32 opposite to the side to which the paddle portion 222 is inclined with respect to the center axis T1 of the support portion 225 upon attachment of the door latch mechanism 3 to the vehicle door) of the key rotor opening 341*a* protrudes substantially vertically upward. That is, the guide portion 341*b* opens upward at the upper edge portion of the key rotor opening 341*a*. As described later, the guide portion 341*b* configured as described above can scoop, from below, the paddle portion 222 inclined (rotated) downward upon attachment of the door latch mechanism 3 to the vehicle door, and can guide the paddle portion 222 to the tip end insertion port of the key rotor 32.

The door latch disengagement lever 33 is a lever configured to disengage the door latch 31 from the striker. The door latch disengagement lever 33 is configured such that a tip end portion thereof protrudes from a vehicle-outer-side surface of the case 34 to the outside of the case, and is attached to the case 34 to rotate in the upper-to-lower direction. The door latch disengagement lever 33 is biased to autonomously return by upward rotation by a biasing spring (not shown).

The door latch disengagement lever 33 is rotatable between a non-disengagement position and a disengagement position. The non-disengagement position is a rotation position when the door latch 31 is not disengaged from the striker, and is a rotation position at which the door latch disengagement lever 33 is rotated upward by the above-described biasing spring. The disengagement position is a rotation position when the door latch 31 is disengaged from the striker, and is a rotation position lower than the non-disengagement position. The door latch disengagement lever 33 is pushed downward by the rod 23 to rotate to the disengagement position. When the door latch disengagement lever 33 is not pushed downward by the rod 23, the door latch disengagement lever 33 is biased upward by the above-described biasing spring, and is rotated to the non-disengagement position.

The door latch disengagement lever 33 includes a rod insertion hole 33*a* into which a lower end portion of the rod 23 can be inserted, and a rod guide portion 33*b* provided at a peripheral edge portion of the rod insertion hole 33*a*.

The rod insertion hole 33*a* penetrates a tip end portion of the door latch disengagement lever 33 in the upper-to-lower direction. The rod guide portion 33*b* is configured to guide the lower end portion of the rod 23 to the rod insertion hole 33*a* upon insertion of the lower end portion of the rod 23 into the rod insertion hole 33*a*. The rod guide portion 33*b* is provided in a peripheral wall shape at the peripheral edge portion of the rod insertion hole 33*a*. The rod guide portion 33*b* expands outward as extending toward a tip end side. Part of the rod guide portion 33*b* in a circumferential direction expands outward in a flat shape so that the rod engagement portion (a crank portion) 23*b* of the lower end portion of the rod 23 can be stably engaged. A lower end side of the rod 23 is inserted into the rod insertion hole 33*a*, and accordingly, the rod 23 is operably coupled to the door latch disengagement lever 33.

When the door latch disengagement lever 33 is rotated to the disengagement position on the lower side by the rod 23, the above-described door latch drive portion rotates the door latch 31 from the engagement position V2 to the disengagement position V1 to hold the rotation position of the door latch 31 at the disengagement position V1. On the other hand, when the rotation position of the door latch 31 is rotated from the disengagement position V1 to the engagement position V2 by the vehicle-body-side striker, the above-described door latch drive portion holds the rotation position of the door latch 31 at the engagement position V2.

The above-described lock/unlock switching portion is configured to inhibit rotation of the door latch 31 to the disengagement position V1 when the key rotor 32 is rotated to the lock position and to allow rotation of the door latch 31 to the disengagement position V1 when the key rotor 32 is rotated to the unlock position. Thus, even when the door latch disengagement lever 33 is pushed downward (i.e., the door handle operation is performed) in a state in which the key rotor 32 is rotated to the lock position, the door latch 31 does not rotate to the disengagement position V1. Only when the key rotor 32 is rotated to the unlock position, if the door latch disengagement lever 33 is pushed downward (i.e., the door handle operation is performed), the door latch 31 rotates to the disengagement position.

Specific configurations of the above-described door latch drive portion and the above-described lock/unlock switching portion are well-known, and therefore, detailed description thereof will be omitted. Each of the above-described door latch drive portion and the above-described lock/unlock switching portion may be of an electric type driven by an electric driver or a mechanical type including no electric driver.

Next, the method for attaching the vehicle door lock device 1 to the vehicle door will be described with reference to FIGS. 7, 8, and 1. Each of FIGS. 7 and 8 is a view for describing the method for attaching the vehicle door lock device 1 to the vehicle door.

Figure 7:
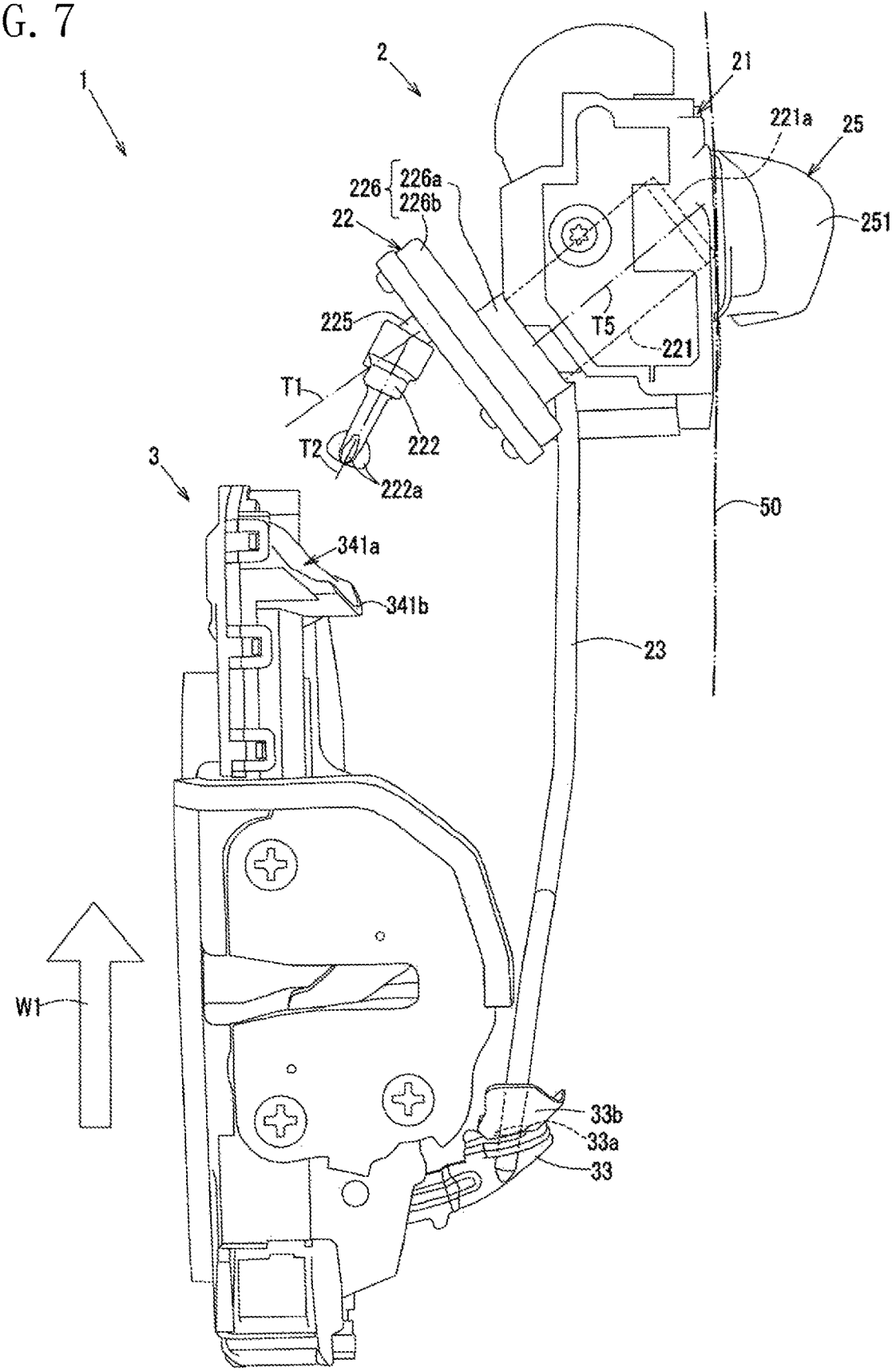
FIG. 7 is a side view for describing the method for attaching the vehicle door lock device to a vehicle door.
Figure 8:
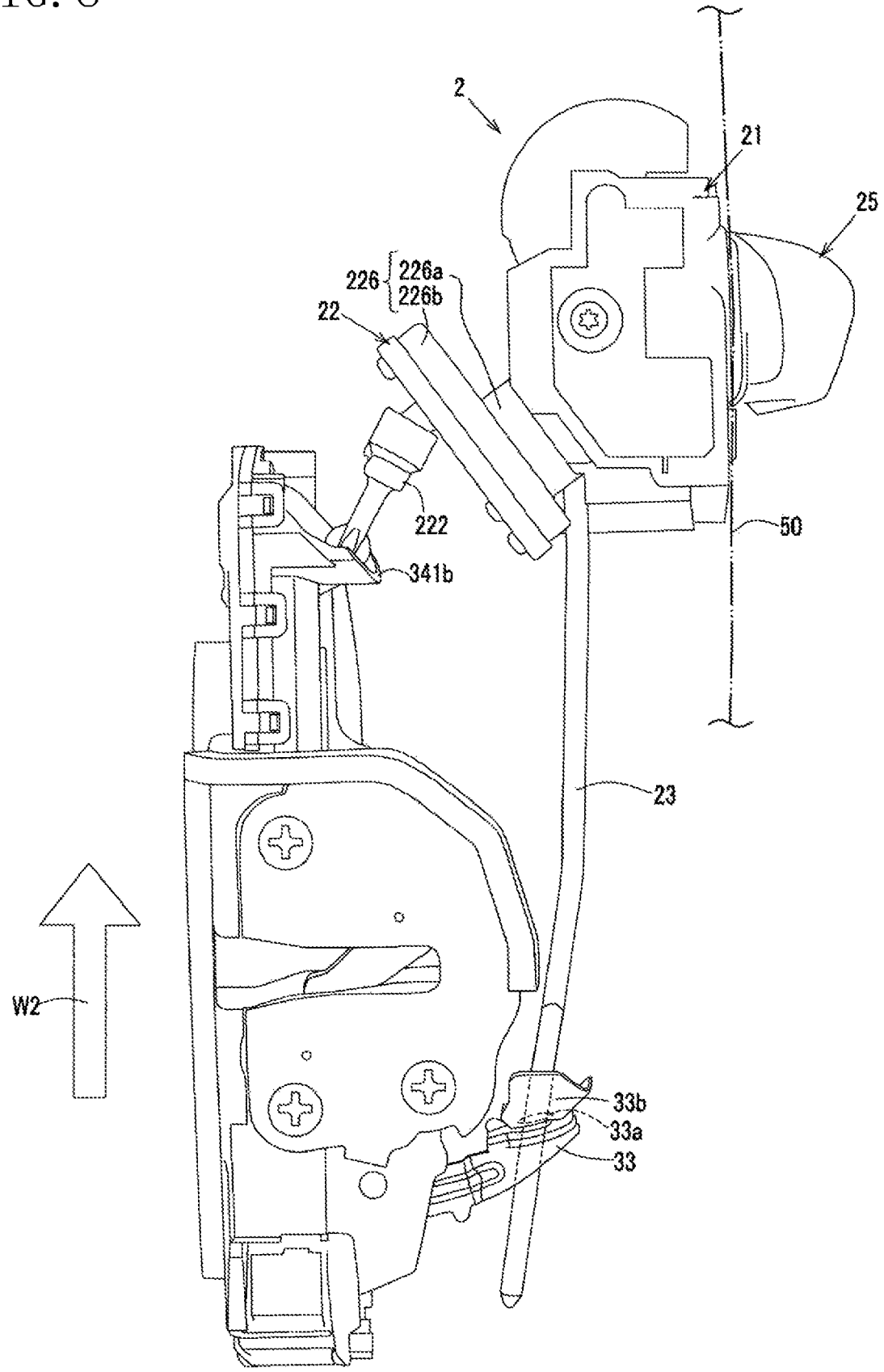
FIG. 8 is another side view for describing the method for attaching the vehicle door lock device to the vehicle door.

As illustrated in FIG. 7, the door handle base unit 2 is first attached to the back side of the door outer panel 50 of the vehicle door. More specifically, the door handle base 21 is attached to the back surface of the door outer panel 50 such that the front surface of the door handle base 21 overlaps with an attachment portion of the back surface of the door outer panel 50. Then, the cylinder lock 22, the rod 23, and the bell crank 24 are attached to the door handle base 21 from the inside of the vehicle door as described above, and the door handle 25 is attached to the door handle base 21 from the vehicle outer side.

Note that after the cylinder lock 22, the rod 23, and the bell crank 24 have been attached to the door handle base 21 in advance, the door handle base 21 may be attached to the attachment portion of the back surface of the door outer panel 50 of the vehicle door.

As described above, in a state in which the door handle base unit 2 is attached to the attachment portion of the back surface of the door outer panel 50 of the vehicle door, the center axis T5 of the key cylinder 221 of the cylinder lock 22 is inclined to the vehicle outer side with respect to the vertical direction. Accordingly, the center axis T1 of the support portion 225 of the cylinder lock 22 is also inclined to the same direction with respect to the vertical direction. The position of the paddle portion 222 is determined such that the paddle portion 222 is inclined downward at the predetermined angle with respect to the center axis T1 of the support portion 225 by the biasing force of the elastic member 222*g* in the paddle portion 222. As described later, the door latch mechanism 3 is attached to the lower side of the door handle base unit 2, and therefore, it can be said that the paddle portion 222 inclined downward at the predetermined angle as described above is rotated between a direction of a center axis T1 of the support portion 225 and a direction inclined with respect to the center axis T1.

Then, the door latch mechanism 3 is, in a substantially vertical orientation state (i.e., a state in which the axis of the door latch mechanism 3 in the upper-to-lower direction is substantially vertical), lifted upward (i.e., toward an arrow direction W1 of FIG. 7) from the lower side of the door handle base unit 2, and is attached to a predetermined portion inside the vehicle door. By such lifting, the lower end portion of the rod 23 of the door handle base unit 2 is first inserted into the rod insertion hole 33*a* of the tip end portion of the door latch disengagement lever 33 of the door latch mechanism 3. Upon such insertion, the lower end portion of the rod 23 is guided to the rod insertion hole 33*a* by the rod guide portion 33*b* provided at the peripheral edge portion of the rod insertion hole 33*a*. Accordingly, the lower end portion of the rod 23 is relatively easily inserted into the rod insertion hole 33*a*.

Then, in this state (i.e., a state in which the lower end portion of the rod 23 is inserted into the rod insertion hole 33*a*), the door latch mechanism 3 is further lifted upward as indicated by an arrow direction W2 of FIG. 8. By such lifting, the guide portion 341*b* of the door latch mechanism 3 scoops, from below, the paddle portion 222 of the door handle base unit 2 as illustrated in FIG. 8. By such scooping, inclination (i.e., the center axis T2 of the paddle portion 222) of the paddle portion 222 becomes substantially coincident with the center axis T1 of the support portion 225 little by little. Accordingly, the tip end portion of the paddle portion 222 slides from the tip end side to a base end side of the guide portion 341*b* on an upper surface of the guide portion 341*b*, and is inserted into the key rotor 32.

Then, when the door latch mechanism 3 is lifted to an attachment portion inside the vehicle door as illustrated in FIG. 1, inclination of the paddle portion 222 is substantially coincident with the center axis T1 of the support portion 225. That is, the center axis T2 of the paddle portion 222 is substantially coincident with the center axis T1 of the support portion 225. In this state, the center axis T2 of the paddle portion 222 is also substantially coincident with the center axis T3 of the key rotor 32. As described above, in a state in which the center axes T1, T2, T3 of the paddle portion 222, the support portion 225, and the key rotor 32 are substantially coincident with each other, the paddle portion 222 is inserted into the back of the key rotor 32, and the engagement portions (the engagement pieces) 222*b* of the paddle portion 222 engage with the engagement grooves 32*b* of the inner peripheral surface of the key rotor 32. That is, the paddle portion 222 is integrally rotatably inserted into the key rotor 32, and is operably coupled to the key rotor 32.

Then, the door latch mechanism 3 is attached to the attachment portion inside the vehicle door. In this manner, the vehicle door lock device 1 is attached to the vehicle door.

Note that when the door latch mechanism 3 is lifted, the door latch mechanism 3 is lifted in an inclined orientation state (i.e., a state in which the door latch mechanism 3 is inclined such that the vehicle-outer-side main surface of two main surfaces of the door latch mechanism 3 faces slightly upward), and is lifted to the attachment portion inside the vehicle door. After the paddle portion 222 has been operably coupled to the key rotor 32, the door latch mechanism 3 may return to a substantially vertical orientation. In this case, insertion of the paddle portion 222 into the key rotor 32 is further facilitated.

As described above, according to the vehicle door lock device 1 of this embodiment, the vehicle door lock device 1 includes the door handle 25 provided at the vehicle door and arranged on the vehicle-outer-side main surface of the vehicle door, the door handle base 21 provided with the cylinder lock 22, and the door latch mechanism 3 provided at the vehicle door and configured to switch to the lock state or the unlock state according to the door key operation for the cylinder lock 22. The cylinder lock 22 includes the key cylinder 21 to be rotated by the door key, the paddle portion 222 operably and detachably coupled to the door latch mechanism 3 and configured to transmit rotation of the key cylinder 221 to the door latch mechanism 3, and the support portion 225 configured to rotatably support the paddle portion 222. The door latch mechanism 3 includes the key rotor 32 into which the paddle portion 222 is detachably inserted and which is configured to rotate in association with rotation of the paddle portion 222 to switch the door latch mechanism 3 to the lock state or the unlocking state. The paddle portion 222 is supported on the support portion 225 to rotate between a direction of a center axis T1 of the support portion 225 and a direction inclined with respect to the center axis.

According to this configuration, the paddle portion 222 of the cylinder lock 22 is supported on the support portion 225 to rotate between a direction of a center axis T1 of the support portion 225 and a direction inclined with respect to the center axis T1. Thus, in a case where the door latch mechanism 3 is attached to the vehicle door after the cylinder lock 22 has been attached to the vehicle door via the door handle base 21, it is easy to operably couple the paddle portion 222 and the key rotor 32 to each other.

Moreover, the key insertion portion 221*a* of the key cylinder 221 is arranged on the back side of the door handle 25 at the vehicle-outer-side main surface of the vehicle door. The door handle 25 is arranged to displace (e.g., move in the horizontal direction) relative to the vehicle door, and exposes or covers the key insertion portion 221*a* of the key cylinder 221 by displacement. Thus, when the door key is not inserted into the key insertion portion 221*a* of the key cylinder 221 (e.g., during vehicle travelling), the key insertion portion 221*a* is covered with the door handle 25. Only when the door key is inserted into the key insertion portion 221*a*, the door handle 25 is displaced so that the key insertion portion 221*a* can be exposed. With this configuration, the key insertion portion 221*a* is exposed so that lowering of quietness of a vehicle in response to travelling wind can be prevented.

The key cylinder 221 is inclined diagonally upward of the vehicle outer side of the vehicle door. Thus, the door key can be inserted into the key cylinder 221 diagonally from the vehicle upper outer side. Thus, even in a case where the door handle 25 is displaced horizontally to the vehicle outer side of the vehicle door to expose the key insertion portion 221*a* of the key cylinder 221, the door key can be inserted into the key cylinder 221 without contacting the door handle 25.

The paddle portion 222 is supported to rotate (i.e., swing) between the direction of the center axis T1 of the support portion 225 and the direction inclined with respect to the center axis T1. Thus, in a case where the door latch mechanism 3 is attached to the vehicle door after attachment of the cylinder lock 22 to the vehicle door, the paddle portion 222 is rotated in the direction (e.g., the lower side) inclined with respect to the center axis T1 of the support portion 225 upon attachment of the door latch mechanism 3 to the vehicle door, and the door latch mechanism 3 is moved to the attachment portion inside the vehicle door from the side to which the paddle portion 222 is rotated. Thus, the paddle portion 222 can be easily inserted into the key rotor 32.

The door latch mechanism 3 includes the guide portion 341*b* configured to guide the paddle portion 222 into the key rotor 32 upon insertion of the paddle portion 222 into the key rotor 32. The paddle portion 222 is rotated in the direction (e.g., the lower side) inclined with respect to the center axis T1 of the support portion 225 upon attachment of the door latch mechanism 3 to the vehicle door. The guide portion 341*b* has the portion protruding to the vehicle outer side of the vehicle door from the side of the periphery of a tip end insertion port of the key rotor 32 to which the paddle portion 222 is inclined with respect to the center axis T1 of the support portion 225 upon attachment of the door latch mechanism 3 to the vehicle door. Thus, in a case where the door latch mechanism 3 is, after attachment of the cylinder lock 22 to the vehicle door, moved from the side (the lower side) to which the paddle portion 222 is inclined to the attachment portion inside the vehicle door and is attached to the attachment portion, the paddle portion 222 can be easily guided and inserted into the tip end insertion port 32*a* of the key rotor 32 by the guide portion 341*b*.

The door handle base 21 includes the rod 23 operated in association with the handle operation for the door handle 25 and operably coupled to the door latch mechanism 3. The door latch mechanism 3 includes the door latch disengagement lever 33 operably coupled to the rod 23 and configured to disengage the door latch 31 of the vehicle door according to operation of the rod 23. The door latch disengagement lever 33 includes the rod insertion hole 33*a* into which the rod 23 is to be inserted, and the rod guide portion 33*b* provided at the peripheral edge portion of the rod insertion hole 33*a* and configured to guide the end portion of the rod 23 to the rod insertion hole 33*a* upon insertion of the rod 23 into the rod insertion hole 33*a*.

According to this configuration, the rod guide portion 33*b* is provided at the peripheral edge portion of the rod insertion hole 33*a* of the door latch disengagement lever 33. Thus, in a case where the door latch mechanism 3 is attached to the vehicle door after attachment of the cylinder lock 22 to the vehicle door, it is easy to operably couple the rod 23 and the door latch disengagement lever 33 to each other.

According to the method for attaching the vehicle door lock device 1 according to this embodiment, the method includes the first step of attaching the door handle base 21 to the vehicle door and attaching the cylinder lock 22 to the door handle base 21, the second step of attaching the door latch mechanism 3 to the vehicle door after the first step, and the third step of rotating (in this embodiment, rotating in the direction inclined downward with respect to the center axis T1 of the support portion 225) the paddle portion 222 of the cylinder lock 22 between a direction of the center axis T1 of the support portion 225 and a direction inclined with respect to the center axis T1 at the first step or after the second step (in this embodiment, at the first step).

According to this configuration, the paddle portion 222 of the cylinder lock 22 is rotated between a direction of the center axis T1 of the support portion 225 and a direction inclined with respect to the center axis T1 at the first step or after the second step. Thus, in a case where the door latch mechanism 3 is attached to the vehicle door after attachment of the cylinder lock 22 to the vehicle door, it is easy to operably couple the paddle portion 222 and the key rotor 32 to each other.

The third step is performed at the first step. At the third step, the paddle portion 222 is rotated in the direction inclined with respect to the center axis T1 of the support portion 225. The second step is performed after the first step and the third step. At the second step, the paddle portion 222 is inserted into the key rotor 32 while the door latch mechanism 3 is moving to the attachment portion of the vehicle door from the side to which the paddle portion 222 is inclined with respect to the center axis T1 of the support portion 225. Thus, in a case where the door latch mechanism 3 is attached to the vehicle door after attachment of the cylinder lock 22 to the vehicle door, the paddle portion 222 can be easily inserted into the key rotor 32.

<First Variation>

Figure 9:
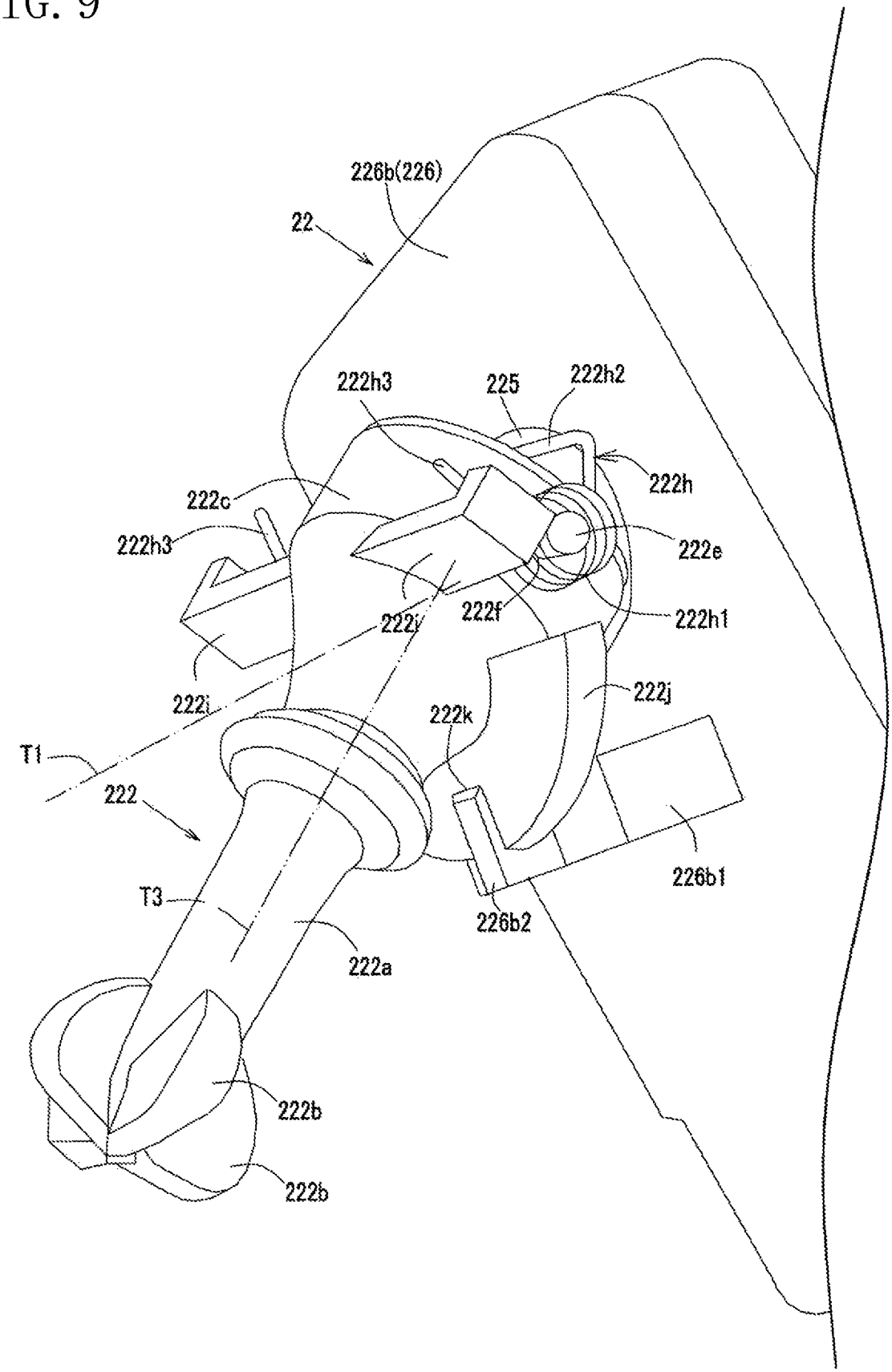
FIG. 9 is a perspective view of a variation of the paddle portion.

FIG. 9 is a perspective view of a variation of the paddle portion 222 of the above-described embodiment. The position of the paddle portion 222 of the above-described embodiment is determined to the direction inclined from the center axis T1 of the support portion 225 by the elastic member 222*g* provided in the coupling portion 222*c*. However, as illustrated in FIG. 9, the paddle portion 222 of the first variation is biased to the direction inclined from the center axis T1 of the support portion 225 by a biasing member 222*h* provided on an outer peripheral surface of the paddle portion 222.

More specifically, in the first variation, the biasing member 222*h* is, for example, a double torsion spring, and includes two coil springs 222*h*1, a substantially U-shaped restriction portion 222*h*2 formed by coupling of end portions of the coil springs 222*h*1, and engagement ends 222*h*3 as free ends of two coil springs 222*h*1.

In the first variation, both end portions of the retaining pin 222*e* of the paddle portion 222 protrude outward of both through-holes 222*f* of the coupling portion 222*c* so that two coil springs 222*h*1 of the biasing member 222*h* can be wound. Protruding engagement target portions 222*i* at which the engagement ends 222*h*3 of the coil springs 222*h*1 can be engaged are provided on an outer peripheral surface of the coupling portion 222*c* of the paddle portion 222. The engagement target portions 222*i* are each provided in the vicinity of the through-holes 222*f*.

In a state in which the biasing member 222*h* is attached to the paddle portion 222, two coil springs 222*h*1 are each wound around both end portions of the retaining pin 222*e*. Two engagement ends 222*h*3 are engaged at the engagement target portions 222*i* of the coupling portion 222*c*. The restriction portion 222*h*2 engages with the outer periphery of the support portion 225, and is biased in the direction of pressing the outer peripheral surface of the support portion 225 by two coil springs 222*h*1. In this state, the paddle portion 222 is biased to one side (e.g., the lower side) of a rotation direction about the retaining pin 222*e* by biasing force of the biasing member 222*h*.

In the first variation, the gear housing portion 226*b* of the cylinder lock 22 has a paddle restriction portion 226*b*1. The paddle restriction portion 226*b*1 is configured to restrict a rotation angle (i.e., the inclination angle of the paddle portion 222 from the center axis T1 of the support portion 225) upon rotation about the retaining pin 222*e* of the paddle portion 222 by the biasing force of the biasing member 222*h*. On the other hand, the paddle portion 222 has a protruding portion 222*j* contacting the paddle restriction portion 226*b*1.

That is, upon rotation about the retaining pin 222*e* of the paddle portion 222 by the biasing force of the biasing member 222*h*, the protruding portion 222*j* contacts the paddle restriction portion 226*b*1 to restrict the rotation angle of the paddle portion 222 upon such rotation to a predetermined angle. In the first variation, when the vehicle door lock device 1 is attached to the vehicle door, the paddle portion 222 is, as in the above-described embodiment, rotated downward with respect to the center axis T1 of the support portion 225 by the biasing force of the biasing member 222*h*, and the protruding portion 222*j* contacts the paddle restriction portion 226*b*1 to adjust the rotation angle to the predetermined angle.

The paddle restriction portion 226*b*1 stands on a support-portion-225-side main surface of two main surfaces of the gear housing portion 226*b* of the cylinder lock 22. The paddle restriction portion 226*b*1 is, for example, formed in a substantially rectangular parallelepiped shape, and a fitting raised portion 226*b*2 to be fitted in a later-described cutout portion 222*k* of the protruding portion 222*j* is provided at a tip end surface of the paddle restriction portion 226*b*1.

The protruding portion 222*j* is provided on the outer peripheral surface of the coupling portion 222*c* of the paddle portion 222. The protruding portion 222*j* is, for example, formed in a fan-shaped wall shape along a circumferential direction of the coupling portion 222*c*. The cutout portion 222*k* in which the fitting raised portion 226*b*2 of the paddle restriction portion 226*b*1 is to be fitted is provided at an arc-shaped tip end side of the protruding portion 222*j*.

In the first variation, when the door handle base unit 2 is attached to the vehicle door, the protruding portion 222*j* of the paddle portion 222 contacts the paddle restriction portion 226*b*1 of the gear housing portion 226*b* by the biasing force of the biasing member 222*h*. Accordingly, the inclination angle of the paddle portion 222 with respect to the center axis T1 of the support portion 225 is adjusted to the predetermined angle. Further, the fitting raised portion 226*b*2 of the paddle restriction portion 226*b*1 is fitted in the cutout portion 222*k* of the protruding portion 222*j*. Accordingly, rotation of the paddle portion 222 about the center axis T2 thereof and rotation of the support portion 225 about the center axis T1 thereof are inhibited.

Since the paddle portion 222 is scooped by the guide portion 341*b* of the door latch mechanism 3, the fitting raised portion 226*b*2 is detached from the cutout portion 222*k* so that the paddle portion 222 can rotate about the center axis T2 of the paddle portion 222 and the support portion can rotate about the center axis T1 of the support portion.

As described above, in a state in which the paddle portion 222 is inclined from the center axis T1 of the support portion 225 by the biasing force of the biasing member 222*h*, rotation of the paddle portion 222 about the center axis T2 thereof and rotation of the support portion 225 about the center axis T1 thereof are inhibited. Thus, when the paddle portion 222 is scooped by the guide portion 341*b* of the door latch mechanism 3, swing of the paddle portion 222 can be reduced, and the paddle portion 222 can be easily inserted into the key rotor 32.

<Second Variation>

Figure 10:
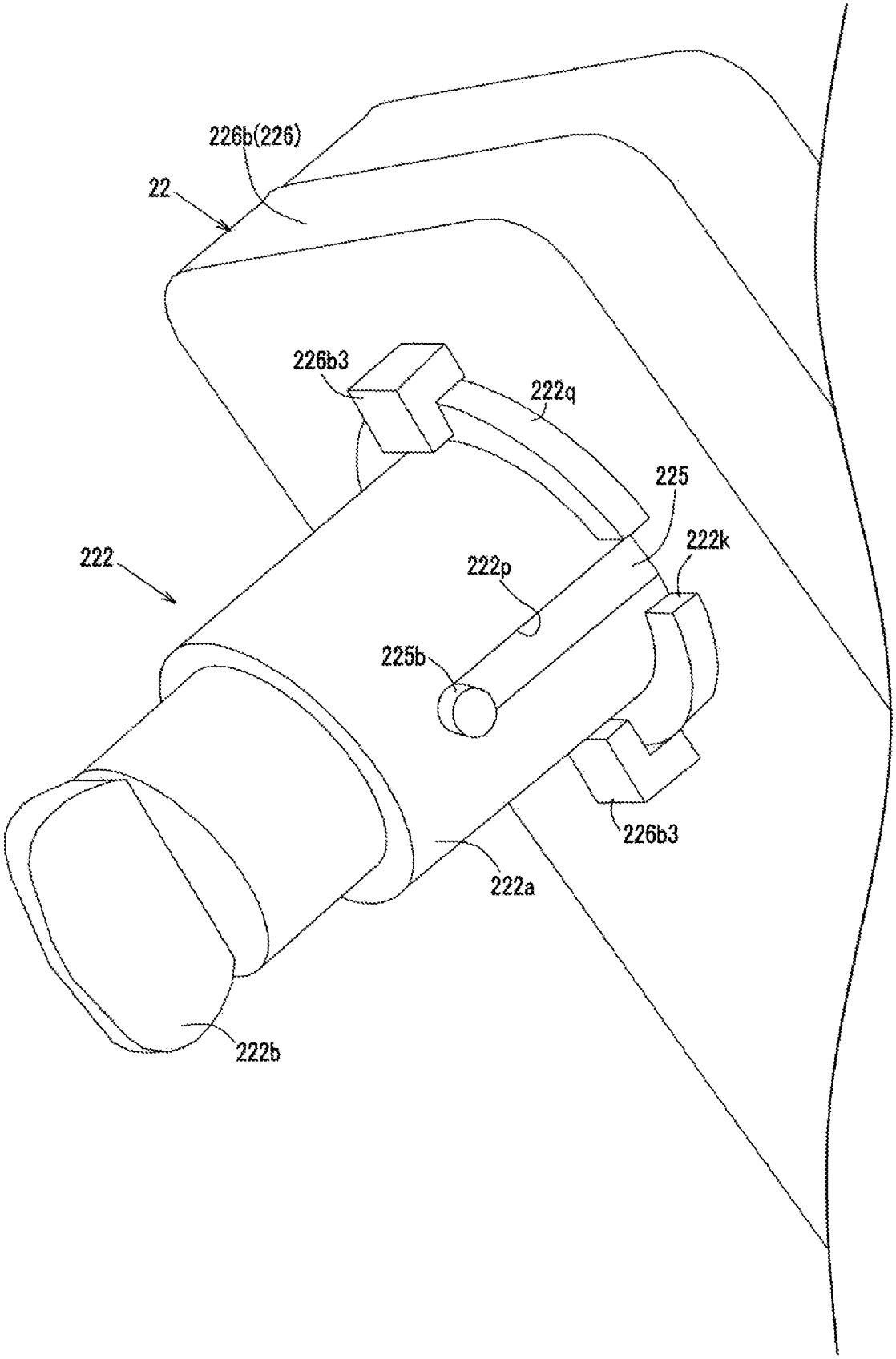
FIG. 10 is a perspective view of another variation of the paddle portion.
Figure 11A:
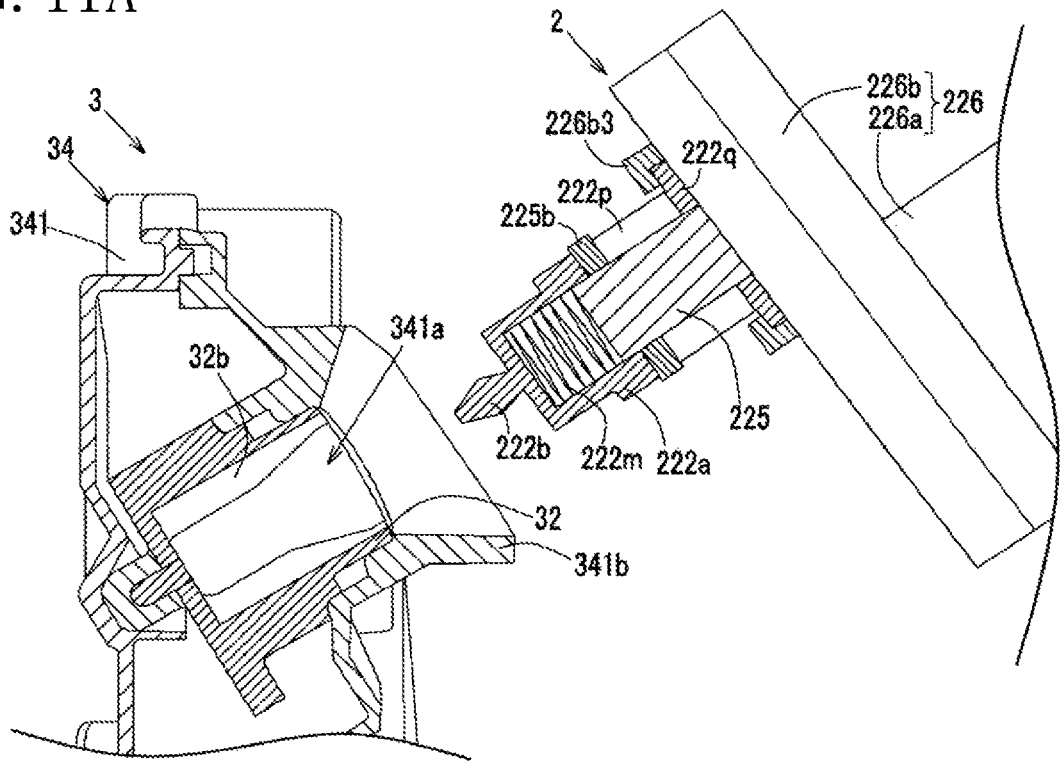
FIG. 11A is a side view for describing the method for attaching the vehicle door lock device in another variation of the paddle portion.
Figure 11B:
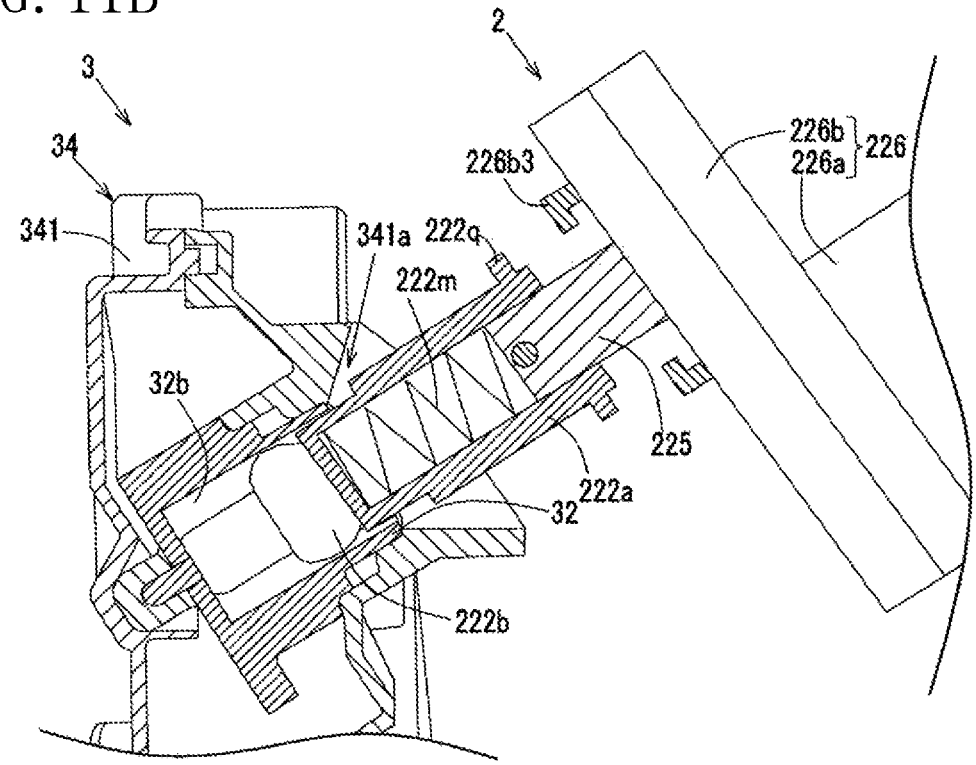
FIG. 11B is a side view for describing the method for attaching the vehicle door lock device in another variation of the paddle portion.

FIG. 10 is a perspective view of another variation of the paddle portion 222, and FIGS. 11A and 11B are side views for describing the method for attaching the vehicle door lock device 1 in another variation of the paddle portion 222.

In the above-described embodiment, the paddle portion 222 is rotated between a direction of a center axis T1 of the support portion 225 and a direction inclined with respect to the center axis T1. However, in the second variation, the paddle portion 222 is, as rotated between a direction of a center axis T1 of the support portion 225 and a direction inclined with respect to the center axis T1, slidable relative to the support portion 225 in the direction of insertion/detachment for the key rotor 32.

More specifically, as illustrated in FIGS. 10 and 11A, the paddle body 222*a* of the paddle portion 222 is, in the second variation, formed in a tubular shape (e.g., a cylindrical shape with a bottom) having a bottom at a tip end and opening at a base end surface. The inside of the paddle body 222*a* houses a spring member (e.g., a coil spring) 222*m* configured to bias the paddle portion 222 toward a tip end side thereof.

A flange portion 222*q* engaging with later-described engagement claws 226*b*3 of the gear housing portion 226*b* of the cylinder lock 22 is provided at the base end portion of the paddle body 222*a*. The flange portion 222*q* projects in a radial direction of the paddle body 222*a*, and is provided across a circumferential direction of the paddle body 222*a*. The cutout portions 222*k* for engagement/disengagement of the engagement claws 226*b*3 are provided at the flange portion 222*q*. The same number of cutout portions 222*k* (e.g., two cutout portions 222*k*) as that of the engagement claws 226*b*3 is provided.

Long holes 222*p* engaging with later-described protruding portions 225*b* of the support portion 225 of the cylinder lock 22 are provided at an outer peripheral surface of the paddle body 222*a*. The long holes 222*p* extend along the center axis of the paddle body 222*a*, and are provided symmetrically with respect to the center axis of the paddle body 222*a* at two portions on both sides of the paddle body 222*a*.

The engagement portion 222*b* of the paddle portion 222 is, for example, formed as a straight protruding piece, and protrudes from a tip end surface of the paddle body 222*a* to a tip end side.

In the second variation, the support portion 225 of the cylinder lock 22 is formed in a shape (e.g., a circular columnar shape) which can be inserted into the tube of the paddle portion 222. The protruding portions 225*b* arranged inside the long holes 222*p* of the paddle portion 222 are provided on the outer peripheral surface of the support portion 225. One or more (e.g., two) engagement claws 226*b*3 stand on the support-portion-225-side main surface of two main surfaces of the gear housing portion 226*b* of the cylinder lock 22. A claw portion of the engagement claw 226*b*3 faces the support portion 225 to engage with an outer peripheral edge of the flange portion 222*q*.

In a state in which the paddle portion 222 is supported on the support portion 225, the support portion 225 is slidably inserted into the tube of the paddle body 222*a*. The protruding portions 225*b* on both sides of the support portion 225 are arranged inside the long holes 222*p* on both sides of the paddle body 222*a*, and are movable along the long holes 222*p*. That is, the paddle portion 222 is slidable to the tip end side (i.e., the side in the direction of insertion into the key rotor 32) of the support portion 225 until each protruding portion 225*b* of the support portion 225 reaches one of both ends of the long hole 222*p*, and is slidable to the base end side (i.e., the side in the direction of detachment from the key rotor 32) of the support portion 225 until each protruding portion 225*b* of the support portion 225 reaches the other one of both ends of the long hole 222*p*.

The spring member 222*m* is arranged between a tip-end-side inner bottom portion of the tube of the paddle body 222*a* and the tip end portion of the support portion 225 in a state in which the spring member 222*m* is compressed in the direction of the center axis of the paddle portion 222, and biases the paddle portion 222 to the tip end side thereof by compression repulsive force.

In a state in which the flange portion 222*q* of the paddle portion 222 engages with the engagement claws 226*b*3 of the gear housing portion 226*b* (FIG. 11A), the paddle portion 222 slides to the base end side of the support portion 225, and such a slide state is held. When the support portion 225 rotates about the center axis thereof and the engagement claws 226*b*3 overlap with the cutout portions 222*k* of the flange portion 222*q*, the engagement claws 226*b*3 are detached from the flange portion 222*q*, and the paddle portion 222 slides to the tip end side of the support portion 225 by compression repulsive force of the spring member 222*m* (FIG. 11B).

In this variation, the vehicle door lock device 1 is attached to the vehicle door as described below. That is, as illustrated in FIG. 11A, the door handle base unit 2 is first attached to the attachment portion of the back surface of the outer panel of the vehicle door (a first step). In such an attachment state, the paddle portion 222 slides to the base end side of the support portion 225, and the engagement claws 226*b*3 engage with the flange portion 222*q*. Thus, such a slide state is held. Then, the door latch mechanism 3 is attached to the attachment portion inside the vehicle door (a second step). Thereafter, as illustrated in FIG. 11B, when the key cylinder 221 is rotated by the door key, the support portion 225 is rotated about the center axis thereof, and the engagement claws 226*b*3 are detached from the flange portion 222*q*. Then, the paddle portion 222 slides to the tip end side of the support portion 225 by biasing force of the spring member 222*m*, and is inserted into the key rotor 32 of the door latch mechanism 3 (a third step). In this state, the engagement portions 222*b* of the paddle portion 222 are not at such a rotation angle that the engagement portions 222*b* can engage with the engagement grooves 32*b* of the key rotor 32, and therefore, do not engage (i.e., not operably coupled) with the engagement grooves 32*b* of the key rotor 32. In this state, when the door key is rotated and returns to a neutral position, the engagement portions 222*b* of the paddle portion 222 are also rotated to a neutral position in association with such rotation. By such rotation, the engagement portions 222*b* engage (i.e., operably coupled) with the engagement grooves 32*b* at such a rotation angle that the engagement portions 222*b* can engage with the engagement grooves 32*b* of the key rotor 32. That is, the paddle portion 222 and the key rotor 32 are operably coupled to each other.

As described above, according to the second variation, the paddle portion 222 is supported to slide in the direction of insertion/detachment for the key rotor 32. Thus, in a case where the door latch mechanism 3 is attached to the vehicle door after attachment of the cylinder lock 22 to the vehicle door, the paddle portion 222 is slid in the direction of detachment from the key rotor 32 upon attachment of the door latch mechanism 3 to the vehicle door, and the paddle portion 222 is slid in the direction of insertion into the key rotor 32 after attachment of the door latch mechanism 3 to the vehicle door. Thus, the paddle portion 222 can be easily inserted into the key rotor 32.

Moreover, the third step is performed after the second step. At the third step, the paddle portion 222 is slid in the direction of insertion into the key rotor 32 on the support portion 225, and is inserted into the key rotor 32. Thus, in a case where the door latch mechanism 3 is attached to the vehicle door after attachment of the cylinder lock 22 to the vehicle door, the paddle portion 222 can be easily inserted into the key rotor 32.

The technique disclosed herein is not limited to the above-described embodiment and variations, and may include combinations of the above-described embodiment and variations.

What is claimed is:

1. A vehicle door lock device comprising:

a door handle provided at a vehicle door;

a door handle base provided at the vehicle door and provided with a cylinder lock; and a door latch mechanism provided at the vehicle door and configured to switch to a lock state or an unlock state according to door key operation for the cylinder lock, wherein the cylinder lock includes a key cylinder to be rotated by a door key, a paddle portion operably and detachably coupled to the door latch mechanism and configured to transmit rotation of the key cylinder to the door latch mechanism, and a support portion configured to rotatably support the paddle portion, the door latch mechanism includes a key rotor into which the paddle portion is detachably inserted and which is configured to rotate in association with rotation of the paddle portion to switch the door latch mechanism to the lock state or the unlocking state, and the paddle portion is supported on the support portion to rotate between a direction of a center axis of the support portion and a direction inclined with respect to the center axis, the door latch mechanism includes a guide portion configured to guide the paddle portion to a tip end insertion port of the key rotor upon insertion of the paddle portion into the key rotor, a position of the paddle portion is determined such that the paddle portion is inclined downward at a predetermined angle with respect to the center axis of the support portion upon attachment of the door latch mechanism to the vehicle door, and the guide portion is formed in the form of a peripheral wall expanding to an outer peripheral side and extending toward a tip end side, and protrudes inclined upward toward a vehicle outer side such that a direction extending along any portion of the outer peripheral side toward the tip end side points no lower than a horizontal direction that extends toward the vehicle outer side, and the guide portion opens upward at an upper edge portion of the tip end insertion port such that a line extending vertically downward intersects a lower side of the guide portion without intersecting an upper side of the guide portion.

2. The vehicle door lock device according to claim 1, wherein a key insertion portion of the key cylinder is arranged on a back side of the door handle at a vehicle-outer-side main surface of the vehicle door, and the door handle is arranged to displace relative to the vehicle door, and exposes or covers the key insertion portion of the key cylinder by displacement.

3. The vehicle door lock device according to claim 1, wherein the key cylinder is inclined diagonally upward of a vehicle outer side of the vehicle door.

4. The vehicle door lock device according to claim 1, wherein the door handle base includes a rod operated in association with handle operation for the door handle and operably coupled to the door latch mechanism, the door latch mechanism includes a door latch disengagement lever operably coupled to the rod and configured to disengage a door latch of the vehicle door according to operation of the rod, and the door latch disengagement lever includes a rod insertion hole into which the rod is to be inserted, and a rod guide portion provided at a peripheral edge portion of the rod insertion hole and configured to guide an end portion of the rod to the rod insertion hole upon insertion of the rod into the rod insertion hole.

5. A method for attaching a vehicle door lock device to a vehicle door, the vehicle door lock device including a door handle provided at the vehicle door, a door handle base provided at the vehicle door and provided with a cylinder lock, and a door latch mechanism provided at the vehicle door and configured to switch to a lock state or an unlock state according to door key operation for the cylinder lock, the cylinder lock including a key cylinder to be rotated by a door key, a paddle portion operably and detachably coupled to the door latch mechanism and configured to transmit rotation of the key cylinder to the door latch mechanism, and a support portion configured to rotatably support the paddle portion, the door latch mechanism including a key rotor into which the paddle portion is detachably inserted and which is configured to rotate in association with rotation of the paddle portion to switch the door latch mechanism to the lock state or the unlocking state, and the paddle portion being supported on the support portion to rotate between a direction of a center axis of the support portion and a direction inclined with respect to the center axis, the door latch mechanism including a guide portion configured to guide the paddle portion to a tip end insertion port of the key rotor upon insertion of the paddle portion into the key rotor, and the guide portion being formed in the form of a peripheral wall expanding to an outer peripheral side and extending toward a tip end side, and protruding inclined upward toward a vehicle outer side such that a direction extending along any portion of the outer peripheral side toward the tip end side points no lower than a horizontal direction that extends toward the vehicle outer side, and the guide portion opening upward at an upper edge portion of the tip end insertion port such that a line extending vertically downward intersects a lower side of the guide portion without intersecting an upper side of the guide portion, the method comprising:

a first step of attaching the door handle base to the vehicle door and attaching the cylinder lock to the door handle base; and a second step of attaching the door latch mechanism to the vehicle door after the first step, wherein a position of the paddle portion is determined such that the paddle portion is inclined downward at a predetermined angle with respect to the center axis of the support portion at the first step, and at the second step, the paddle portion is inserted into the key rotor while the door latch mechanism is moving to an attachment portion of the vehicle door from the side to which the paddle portion is inclined with respect to the center axis of the support portion.

6. The vehicle door lock device according to claim 1, wherein the paddle portion is provided with an insertion recessed portion into which a tip end portion of the support portion is capable of being inserted, an elastic member is arranged in the insertion recessed portion, and the elastic member is configured to contact a tip end surface of the support portion in a coupling state of the paddle portion and the support portion to determine the position of the paddle portion at a position inclined at a predetermined angle with respect to the center axis of the support portion.

7. The vehicle door lock device attachment method according to claim 5, wherein the paddle portion is provided with an insertion recessed portion into which a tip end portion of the support portion is capable of being inserted, an elastic member is arranged in the insertion recessed portion, the elastic member is configured to contact a tip end surface of the support portion in a coupling state of the paddle portion and the support portion to determine the position of the paddle portion at a position inclined at a predetermined angle with respect to the center axis of the support portion, and at the first step, the door handle base is attached to a back surface of a door outer panel such that a front surface of the door handle base overlaps with an attachment portion of the back surface of the door outer panel, and in the state, a center axis of the key cylinder and the center axis of the support portion are inclined to the vehicle outer side with respect to the vertical direction, and the position of the paddle portion is determined such that the paddle portion is inclined downward at a predetermined angle with respect to the center axis of the support portion by the elastic member.

8. The vehicle door lock device attachment method according to claim 7, wherein at the second step, the door latch mechanism is, in a state in which an axis of the door latch mechanism in an upper-to-lower direction is substantially vertical, lifted upward from a lower side of the door handle base, whereby a lower end portion of the rod of the door handle base is inserted into a rod insertion hole of a tip end portion of a door latch disengagement lever of the door latch mechanism, in the state where the lower end portion of the rod is inserted into the rod insertion hole, the door latch mechanism is further lifted upward, and by the lifting, the guide portion scoops, from below, the paddle portion, and by the scooping, inclination of the paddle portion becomes substantially coincident with the center axis of the support portion little by little, whereby a tip end portion of the paddle portion slides from the tip end side to a base end side of the guide portion, and is inserted into the key rotor, and when the door latch mechanism is lifted to an attachment portion inside the vehicle door, inclination of the paddle portion is substantially coincident with the center axis of the support portion, and the paddle portion is inserted into a back of the key rotor, and an engagement portion of the paddle portion engages with an engagement groove of the key rotor.

* * * * *